US011230923B2

(12) United States Patent
Proett

(10) Patent No.: US 11,230,923 B2
(45) Date of Patent: Jan. 25, 2022

(54) APPARATUS AND METHOD FOR DETERMINING PROPERTIES OF AN EARTH FORMATION WITH PROBES OF DIFFERING SHAPES

(71) Applicant: Mark A. Proett, Missouri City, TX (US)

(72) Inventor: Mark A. Proett, Missouri City, TX (US)

( * ) Notice: Subject to any disclaimer, the term of this patent is extended or adjusted under 35 U.S.C. 154(b) by 86 days.

(21) Appl. No.: 16/736,408

(22) Filed: Jan. 7, 2020

(65) Prior Publication Data

US 2020/0217195 A1 Jul. 9, 2020

Related U.S. Application Data

(60) Provisional application No. 62/789,575, filed on Jan. 8, 2019.

(51) Int. Cl.

| | |
|---|---|
| ***E21B 49/00*** | (2006.01) |
| ***E21B 49/10*** | (2006.01) |
| ***E21B 49/08*** | (2006.01) |
| ***E21B 47/06*** | (2012.01) |

(52) U.S. Cl.

CPC ..... *E21B 49/008* (2013.01); *E21B 47/06* (2013.01); *E21B 49/087* (2013.01); *E21B 49/10* (2013.01)

(58) Field of Classification Search

CPC ..... E21B 47/06; E21B 49/008; E21B 49/087; E21B 49/10

See application file for complete search history.

(56) References Cited

U.S. PATENT DOCUMENTS

| | | | | |
|---|---|---|---|---|
| 3,452,592 | A * | 7/1969 | Voetter | E21B 49/10 73/152.26 |
| 5,279,153 | A | 1/1994 | Dussan et al. | |
| 5,602,334 | A | 2/1997 | Proett et al. | |
| 5,672,819 | A | 9/1997 | Chin et al. | |
| 6,230,557 | B1 * | 5/2001 | Ciglenec | E21B 49/10 73/152.01 |
| 6,301,959 | B1 | 10/2001 | Hrametz et al. | |
| 6,478,096 | B1 | 11/2002 | Jones et al. | |
| 6,585,045 | B2 * | 7/2003 | Lee | E21B 49/10 166/252.5 |
| 7,059,179 | B2 | 6/2006 | Proett et al. | |
| 7,128,144 | B2 | 10/2006 | Fox et al. | |
| 7,224,162 | B2 | 5/2007 | Proett et al. | |
| 7,654,321 | B2 * | 2/2010 | Zazovsky | E21B 49/10 166/264 |

(Continued)

OTHER PUBLICATIONS

Paper No. SPWLA-2016-V Published: Jun. 25, 2016 Improving the Interpretation of Formation-Tester Measurements with Expedient and Detailed Numerical Simulations Juan D. Escobar Gómez; Carlos Torres-Verdin; Mark A. Proett; Shouxiang M. Ma Paper presented at the SPWLA 57th Annual Logging Symposium, Reykjavik, Iceland, Jun. 2016.

(Continued)

*Primary Examiner* — John Fitzgerald
(74) *Attorney, Agent, or Firm* — Ira Domnitz

(57) ABSTRACT

An improved formation testing method for measuring at least three formation parameters such as spherical permeability, permeability anisotropy, well bore skin damage, with at least two short duration pressure tests using a formation tester with two or more probe flow areas of different shapes.

20 Claims, 12 Drawing Sheets

(56) References Cited

U.S. PATENT DOCUMENTS

| | | | | |
|---|---|---|---|---|
| 7,841,406 | B2 * | 11/2010 | Zazovsky | E21B 47/01 166/264 |
| 9,115,571 | B2 * | 8/2015 | Brennan, III | E21B 49/10 |
| 9,284,837 | B2 * | 3/2016 | Proett | E21B 49/10 |
| 9,422,811 | B2 | 8/2016 | Bedouet et al. | |
| 9,752,433 | B2 | 9/2017 | Proett et al. | |
| 10,156,138 | B2 * | 12/2018 | Irani | E21B 49/08 |
| 10,329,908 | B2 * | 6/2019 | Fox | E21B 49/10 |
| 10,738,607 | B2 * | 8/2020 | Proett | E21B 17/1021 |
| 2006/0076132 | A1 * | 4/2006 | Nold, III | E21B 49/10 166/264 |
| 2007/0039731 | A1 * | 2/2007 | Fox | E21B 49/10 166/264 |
| 2008/0156487 | A1 * | 7/2008 | Zazovsky | E21B 47/01 166/264 |
| 2010/0132940 | A1 * | 6/2010 | Proett | E21B 49/10 166/250.17 |
| 2011/0162836 | A1 * | 7/2011 | Church | E21B 49/10 166/264 |
| 2011/0284212 | A1 * | 11/2011 | Tao | E21B 49/10 166/119 |
| 2013/0213645 | A1 * | 8/2013 | Proett | E21B 49/10 166/250.17 |
| 2015/0068736 | A1 * | 3/2015 | Dirksen | E21B 44/005 166/250.01 |
| 2020/0362699 | A1 * | 11/2020 | Zainalabedin | E21B 49/10 |

OTHER PUBLICATIONS

Paper No. SPE-181445-MS Published: Sep. 26-28, 2016 Evaluating the Impact of Multiphase Flow Properties on Formation-Tester Pressure Transients Juan D. Gómez, Carlos Torres-Verdin, Mark A. Proett, Shouxiang Ma Publisher: Society of Petroleum Engineers (SPE).

Paper No. SPE-64650-MS Published: Nov. 7-10, 2000 Advanced Dual Probe Formation Tester with Transient, Harmonic, and Pulsed Time-Delay Testing Methods Determines Permeability, Skin, and Anisotropy Mark A. Proett, Wilson C. Chin, Batakrishna Mandal.

Paper No. SPE-143302-PA Published: Mar. 31, 2011 A Robust Method for Calculating Formation Mobility With a Formation Tester E.B. Dussan. V Journal: SPE Reservoir Evaluation & Engineering.

Paper No. SPE-183791-MS Published: Mar. 6-9, 2017 Analyzing Pressure Transient and Steady State Drawdown Data From Current Formation Tester Tools in Vertical and Deviated Wells With a Consistent Approach Leif Larsen; Olivier Allain.

* cited by examiner

APPARATUS AND METHOD FOR DETERMINING PROPERTIES OF AN EARTH FORMATION WITH PROBES OF DIFFERING SHAPES

CROSS-REFERENCE TO RELATED APPLICATIONS

This patent application claims priority to U.S. Patent Application 62/789,575 filed on Jan. 8, 2019, and incorporates all content of said applications as if set forth in full herein.

STATEMENT REGARDING FEDERALLY SPONSORED RESEARCH

Not applicable.

BACKGROUND

The invention is related to the field of instruments used to sample fluids contained in the pore spaces of earth formations. More specifically, the invention is related to methods of determining hydraulic properties of anisotropic earth formations by interpreting fluid pressure and flow rate measurements made by such instruments.

Electric wireline formation testing instruments are used to withdraw samples of fluids contained within the pore spaces of earth formations and to make measurements of fluid pressures within the earth formations. Calculations made from these pressure measurements and measurements of the withdrawal rate can be used to assist in estimating the total fluid content within a particular earth formation.

The oil and gas industry typically conducts comprehensive evaluation of underground hydrocarbon reservoirs prior to their development. Formation evaluation procedures generally involve collection of formation fluid samples for analysis of their hydrocarbon content, estimation of the formation permeability and directional uniformity, determination of the formation fluid pressure, mobility, permeability and many others. Measurements of such parameters of the geological formation are typically performed using many devices including downhole formation testing tools.

Recent formation testing tools generally comprise an elongated tubular body divided into several modules serving predetermined functions. A typical tool may have a hydraulic power module that converts electrical into hydraulic power; a telemetry module that provides electrical and data communication between the modules and an up-hole control unit; one or more probe modules collecting samples of the formation fluids; a flow control module regulating the flow of formation and other fluids in and out of the tool; and a sample collection module that may contain various size chambers for storage of the collected fluid samples. The various modules of a tool can be arranged differently depending on the specific testing application, and may further include special testing modules, such as nuclear magnetic resonance (NMR) measurement equipment.

In certain applications the tool may be attached to a drill bit for logging-while-drilling (LWD) or measurement-while drilling (MWD) purposes. Examples of such multifunctional modular formation testing tools are described in U.S. Pat. Nos. 5,934,374; 5,826,662; 4,936,139; and 4,860,581.

In several embodiments, the present invention is over the prior art as, the present invention can have: at least one probe with at least one port aperture; at least one additional aperture with a different shape or multiple apertures used to form a different effective shape; pressure measured from at least two flowing apertures is processed to determine anisotropy $K_v/K_h$; pressure is simultaneously measured from the non-flowing apertures gauges (i.e., monitoring apertures); pressure from at least one non-flowing monitoring aperture is processed to determine $K_v$, $K_h$ and S; and/or with two or more probes or a repositioning of the tool at different depths enables the determination of formation parameters such as dip angle and or two or more formation layer properties (i.e., $K_{vn}$, $K_{hn}$ and Sn with "n" being the layer number). Alternatively, both apertures can be flowing simultaneously and by varying the rates from either aperture $K_v$, $K_h$ and S is determined using the pressure measurement from both probes.

SUMMARY OF THE INVENTION

In several embodiments, the present invention discloses a new method of using the short duration pretesting to determine at least three formation properties (from at least two tests) such as the formation skin damage, permeability in at least one direction or a combination thereof (i.e., vertical, horizontal, radial, longitudinal spherical, etc.) and anisotropy. This is done by using probes of different effective shapes that have different pressure responses to at least one formation property such as anisotropy. By performing independent pressure tests with at least two probes the pressure and flow data is used to determine that property. Then by preforming at least one interference test between the probes where flow is induced from the formation from at least one of the probes and the pressures are monitored at both probes, a component of the permeability between the probes can be determined (i.e., spherical, vertical or horizontal). The formation skin damage can be determined using the probe shape dependent property such as the anisotropy and the component of permeability from the interference tests.

Formation testing normally involves analyzing pressure transients created by changing the pressure of the formation by withdrawing or injecting fluid into the formation followed by a period of pressure stabilization. The pressure transients can then be analyzed to determine one or more formation properties. The disadvantage to this method is that it can be very time consuming, inconclusive, limited to a few formation properties and operational conditions distorting the pressure transient. These issues are more pronounced when using a wireline or LWD formation tester in open-hole conditions encountered soon after drilling a formation interval. Typically, an open-hole formation tester with a single probe is used to perform a short duration test and only one property can be determined definitively, which is the spherical mobility (or spherical permeability if the viscosity is known). The spherical mobility determined will include the influence due to formation damage near the well bore characterized by the skin coefficient S. This skin coefficient can be determined if the pressure transient is adequate, but in most open-hole conditions this cannot be resolved accurately with a short duration transient. In addition, the spherical mobility determination is influenced by the anisotropy. If a second probe is used the mobility related to the direction between the probes can be determined without the skin effect. If the skin or anisotropy cannot be determined, then the actual formation spherical permeability and anisotropy cannot be determined with accuracy. A third probe could be added but this adds significantly to the testing complexity, testing time and reliability. The skin damage magnitude can range from 0 to over 10 and directly impacts the mobility and anisotropy measurements.

One of the embodiments of this invention uses two different probe aperture shapes that enable the anisotropy to be determined by comparing pressure disturbance and flow rates from both probes. Then by measuring the pressure disturbance that propagates to the second aperture, as in an interference test, the mobility in one direction is determined. An interference test can consist of flowing from one probe aperture while a second probe aperture is not flowing. An interference test can also be performed when both probe apertures can be flowing simultaneously, and the rate is varied from the either probe aperture. In both cases the pressure and flow rates are monitored from both probe apertures and pressure changes are observed when the flow rate is changed from either aperture. From the anisotropy and directional mobility results the actual spherical mobility can be determined without the skin effect. The skin magnitude can be determined using the pressure disturbance and flow rates from either probe because it is related to spherical mobility, anisotropy and skin. These properties are now determined using short duration tests where the magnitude of the pressure disturbance is used rather than the full pressure transient.

In one embodiment of the present invention, the method used in this embodiment and others involves determining the flow coefficients for both probes used for estimating the spherical mobility where the flow coefficient is a function of a formation property such as anisotropy. The probe aperture shapes are designed to create a different response function for the flow coefficients related to the property of interest such as anisotropy. The second step involves determining the flow coefficients for that property related to the direction between the probes. This enables at least one additional property to be determined such as skin from two or more tests.

In some embodiments of the present invention, the flow coefficients for probes of different shapes can be related to more than one property. These are generally geometric in nature, such as formation bed dip angle, tool borehole azimuthal angle, and distance to one or more bedding boundaries. If the tool is moved in the borehole to a new depth and/or azimuthal angle, additional measurements can be made to improve the accuracy of the properties determined using a library of probe coefficients for the test conditions encountered and regression methods. In addition, it is possible to introduce additional parameters such as multiple bedding plane layers in a formation interval, with each bed having a thickness, boundary condition, mobility, anisotropy and skin. Formation pressure measurements made along the wellbore can also be incorporated by using gradient analysis techniques that can delineate layer boundary and boundary conditions. In this embodiment, a large number of measurements is used to determine the formation interval properties using regression techniques such as error minimization, multivariant analysis and perturbation methods. Because the measurements can be made with short duration tests there is significant time savings. In addition, using simple pressure magnitudes rather than full transients simplifies the analysis while improving the accuracy.

BRIEF DESCRIPTION OF THE DRAWINGS

For a more complete understanding of the present disclosure and the advantages thereof, reference is now made to the following descriptions to be taken in conjunction with the accompanying drawings describing specific embodiments of the disclosure, wherein.

DETAILED DESCRIPTION

Figure 1C:
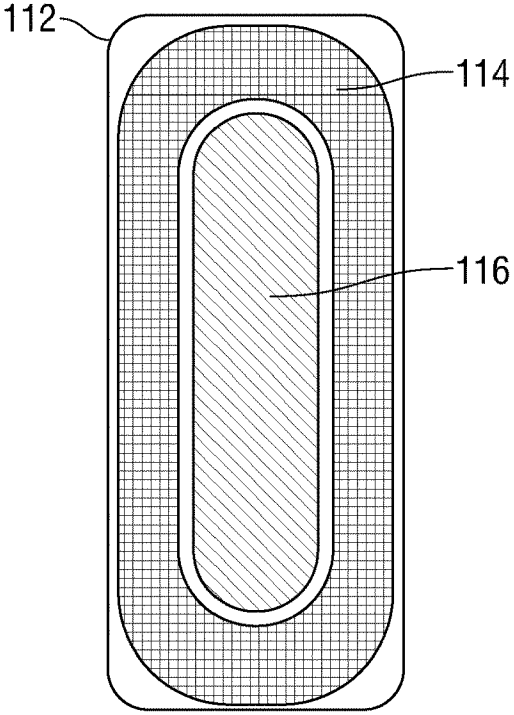
FIG. 1*c* is one embodiment of a typical probe oval or elongated shape in top view.

In the following description, certain details are set forth such as specific quantities, sizes, etc., so as to provide a thorough understanding of the present embodiments disclosed herein. However, it will be evident to those of ordinary skill in the art that the present disclosure may be practiced without such specific details. In many cases, details concerning such considerations, and the like, have been omitted inasmuch as such details are not necessary to obtain a complete understanding of the present disclosure and are within the knowledge of persons of ordinary skill in the relevant art.

Referring to the drawings in general, it will be understood that the illustrations are for the purpose of describing particular embodiments of the disclosure and are not intended to be limiting thereto. Drawings are not necessarily to scale, and arrangements of specific units in the drawings can vary.

While most of the terms used herein will be recognizable to those of ordinary skill in the art, it should be understood, however, that when not explicitly defined, terms should be interpreted as adopting a meaning presently accepted by those of ordinary skill in the art. In cases where the construction of a-term would render it meaningless, or essentially meaningless, the definition should be taken from Webster's Dictionary, 11th Edition, 2016. Definitions, and/or interpretations, should not be incorporated from other patent applications, patents, or publications, related or not, unless specifically stated in this specification or if the incorporation is necessary for maintaining validity. "Skin damage" is defined herein, as an impairment to the reservoir and is caused primarily by the wellbore fluids used during drilling/completion and workover operations. It is a zone of reduced permeability within the vicinity of the wellbore as a result of foreign-fluid invasion into the reservoir rock which can reduce production due to the mechanical deposit of suspended fluid particles into pore spaces or the interaction of the fluids with the formation rock elements. The formation skin damage increases the pressure differential required to produce reservoir fluids as much as ten times. The non-dimensional skin parameter S defines the magnitude of the pressure increase required for production. "Permeability", as used herein, is defined by Dary's law and is a measurement of relationship between the pressure and fluid flow rate in a porous media. The spherical permeability $k_s$ is generally determined where the fluid flows into the source in all directions forming a predominately spheroidal pressure field. Horizontal permeability $k_h$ is frequently referenced a directional component of permeability that is parallel to a formation bedding plane where vertical permeability $K_v$ is orthogonal to the bedding plane. The permeability anisotropy is the ratio of vertical to horizontal permeability $k_v/k_h$. Addition terms for directional permeability are radial $k_r$, or $k_x$, $k_y$ and $k_z$ in which x, y and z refer to an arbitrary Cartesian coordinate system. In the most general case permeability can be defined as a tensor with properties in two directions with a directional vector referenced to a chosen ordinate system and the permeability anisotropy being the ratio of the permeabilities defined by the tensor. Frequently flow thru porous media is referred to as mobility M which is the ratio or permeability k to the viscosity of the fluid μ or k/μ.

Certain terms are used in the following description and claims to refer to particular system components. As one skilled in the art will appreciate, different persons may refer to a component by different names. This document does not intend to distinguish between components that differ in name, but not function. The drawing figures are not necessarily to scale. Certain features of the invention may be shown exaggerated in scale, or in somewhat schematic form, and some details of conventional elements may not be shown, all in the interest of clarity and conciseness.

Although several preferred embodiments of the present invention have been described in detail herein, the invention is not limited hereto. It will be appreciated by those having ordinary skill in the art that various modifications can be made without materially departing from the novel and advantageous teachings of the invention. Accordingly, the embodiments disclosed herein are by way of example. It is to be understood that the scope of the invention is not to be limited thereby.

In several embodiments, the present invention is a method and apparatus for testing a formation, the method and apparatus comprising: one or more probes that can have one or more openings, that can be placed in sealing communication with the formation, where the openings are shaped or combined hydraulically to have different geometrical effective shapes such that two or more shapes are characterized with flow functions having sensitivities to at least one formation property, such as the permeability or mobility anisotropy where fluid is withdrawn or injected at a controlled rate from one and/or a combination of probe openings in a testing sequence consisting of at least two flow periods creating one or more pressure pulses in the formation region in proximity to the probe openings and the pressure being monitored from each probe enabling three or more formation properties to be determined such as permeability; anisotropy; vertical permeability; horizontal permeability; spherical permeability; wellbore skin damage; formation bedding plane relative dip angle; probe opening azimuthal angle; formation bedding plane dimensions; multiple beds and bedding interval lengths.

In several embodiments of the present invention, a flow coefficient function can be defined for each probe opening shape or combined effective shape relating the pressure and single flow rate to at least one formation property. In several embodiments of the present invention, a flow coefficient function can be defined for each probe opening shape or combined effective shape relating the pressure and an oscillating flow rate for at least one formation property. In several embodiments of the present invention, a function for a flow coefficient can be defined with an analytical model for each probe opening shape or a combination of shapes forming an effective geometry relating the testing pressure and flow rate data to at least one formation property. In several embodiments of the present invention, the flow coefficient functions can be defined using numerical simulations for each probe opening shape or a combination of shapes forming an effective geometry relating the testing pressure and flow rate data to at least one formation property. In several embodiments of the present invention, a library of numerical simulations can be created with each probe opening shape or combined effective geometry relating the pressure and flow rate to at least one formation property. In several embodiments of the present invention, a multivariant, neural network or perturbation analysis methods can be developed from a library of flow coefficients' data that would interpolate between the wide ranges of formation conditions to characterize flow coefficients for at least one formation property. In several embodiments of the present invention, the flow coefficient functions are used to solve for at least three formation properties using at least two flow tests employing analytical methods to determine algebraic closed-form solutions. In several embodiments of the present invention, the flow coefficient functions are used to solve for at least three formation properties using pressure and flow data from at least two flow tests using regression methods such as linear regression, nonlinear regression and/or error minimization. In several embodiments of the present invention, the testing is performed at two or more depth locations along the wellbore to determine at least three formation properties along the interval tested.

In several embodiments, the present invention is an apparatus for estimating at least three properties of an earth formation containing a formation fluid, comprising: at least one probe is in sealing communication with the formation; two or more probe apertures of different shapes that can be independently sealed in communication with the formation; device for creating a pressure disturbance in the formation by withdrawal or injection of fluids into the formation fluids from at least one aperture; device for measuring a pressure disturbance magnitude from the apertures; device of estimating at least one formation property using two or more apertures related to the difference in their shapes; device of measuring a component of at least one formation property that is directionally related to the spatial orientation of the apertures by measuring the pressure from at least one aperture used to create the disturbance to at least one monitoring the pressure disturbance, determining at least one additional formation property related to the aperture shapes and the apertures' positions.

In several embodiments, there are two or more separated probes that have at least one aperture of a different shape where the two are used separately or coupled together hydraulically to create a third effective shape. In several embodiments, there is a single probe or probes consisting of at least two apertures of a different shape where the apertures are used separately or coupled together hydraulically to create a third effective shape. In several embodiments, there is a single probe consisting of at least one smaller aperture that is positioned inside of a larger aperture and any of the apertures are used separately or coupled together hydraulically to create a different effective shape. In several embodiments, there is a single probe consisting of at least three apertures of the same shape and two or more of the apertures are coupled together hydraulically to create at least two different effective shapes. In several embodiments, an expanding element consisting of at least two apertures of a different shape where the apertures can be used separately or coupled together hydraulically to create a third effective shape. In several embodiments of the present invention, the expanding element consisting of at least three apertures of the same shape or two or more of different shapes and two or more of the apertures can be coupled together hydraulically to create at least one more effective shape. In several embodiments, the pressure disturbance is created by a single withdrawal of fluid at a measured rate from one or more of the apertures followed by a stabilization where the magnitude of the pressure is the difference in the pressure at the end of the flow period and the end of the stabilization time period. In several embodiments, the pressure disturbance is a series of fluid withdrawals and injections creating a pressure wave and the pressure magnitude is a measurement of the pressure wave such as the peak to peak pressure differential. In some embodiments, the pressure disturbance is a series of fluid withdrawals and injections creating a pressure wave and a shift in phase is measured by comparing the wave from the aperture creating the disturbance to at least one monitoring aperture wave. In some embodiments, at least three formation properties are determined, including but not limited to: spherical permeability or mobility; the permeability or mobility in at least one direction; permeability or mobility anisotropy; skin damage of at least one formation bed; distance to one bed boundary; thickness of at least one bed boundary; relative dip angle of borehole to bedding boundaries, azimuthal displacement around the borehole and properties of multiple bedding planes in a formation interval.

Figure 1B:
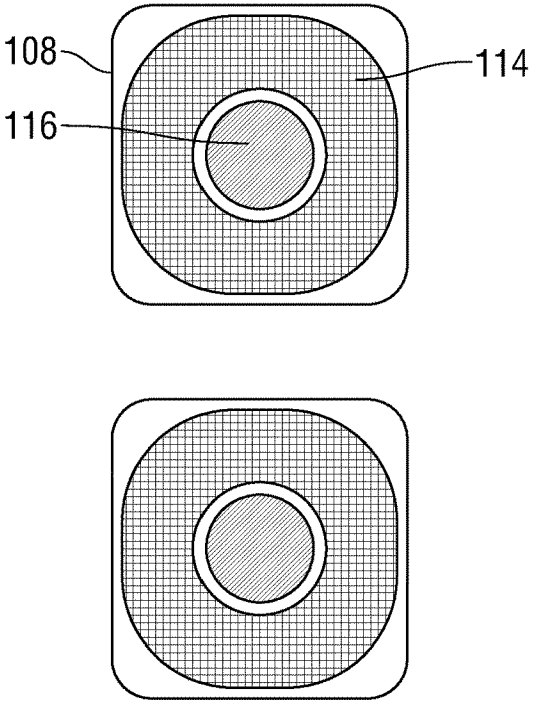
FIG. 1*b* is one embodiment of a typical probe in circular shape top view.
Figure 1A:
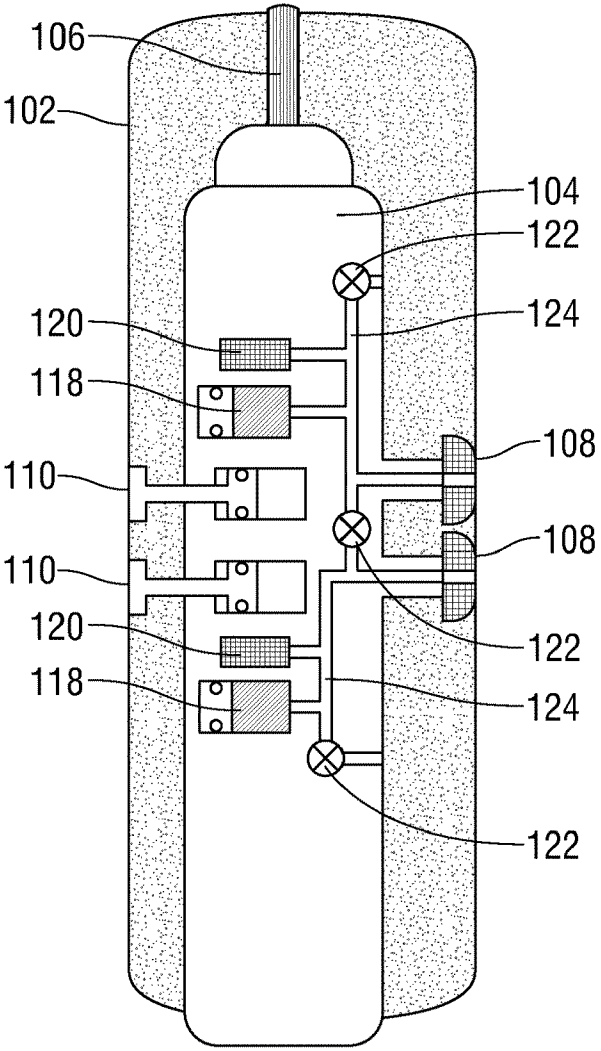
FIG. 1*a* is one embodiment of a typical multi-probed formation tester in a borehole with the essential components needed to pressure test an earth formation in side view.

A typical formation testing tool is illustrated schematically in FIGS. 1*a*-*c*, which shows typical components of an underground formation tester device, such as a probe 108 with an inlet 116 providing fluid communication to the interior of the device, fluid lines 124, various valves 122 and pumps 118 for regulating the fluid flow rates. In various testing applications prior art tools may use more than one probe, as shown in FIGS. 1*a*-1*c*.

In a typical operation, formation-testing tools operate as follows: Initially, the tool 104 is lowered on a wireline 106 into the borehole 102 to a desired depth and the probes 108 for taking samples of the formation fluids are extended into a sealing contact with the borehole wall 102. Formation fluid is then drawn into the tool through probe inlets 116, and the tool can perform various tests of the formation properties, as known in the art.

Prior art wireline formation testers typically rely on probe-type devices to create a hydraulic seal with the formation in order to measure pressure and take formation samples. Typically, these devices use a toroidal rubber cup-seal 114, which is pressed against the side of the wellbore 102 while a probe is extended from the tester in order to extract wellbore fluid and affect a drawdown. The flowlines 124 and valves 122 can be configured to change the flow to be directed to extract formation fluid from one or both of the probes. Typically, each probe has a dedicated pressure gauge 120 that is in hydraulic communication with the probe inlet 116 to independently monitor the pressure during the testing or sampling process. In addition to circular probes, one or more elongated oval shaped probes are also employed, as shown in FIG. 1*c*. Examples of oval probes are shown in U.S. Pat. No. 7,128,144.

Figure 2:
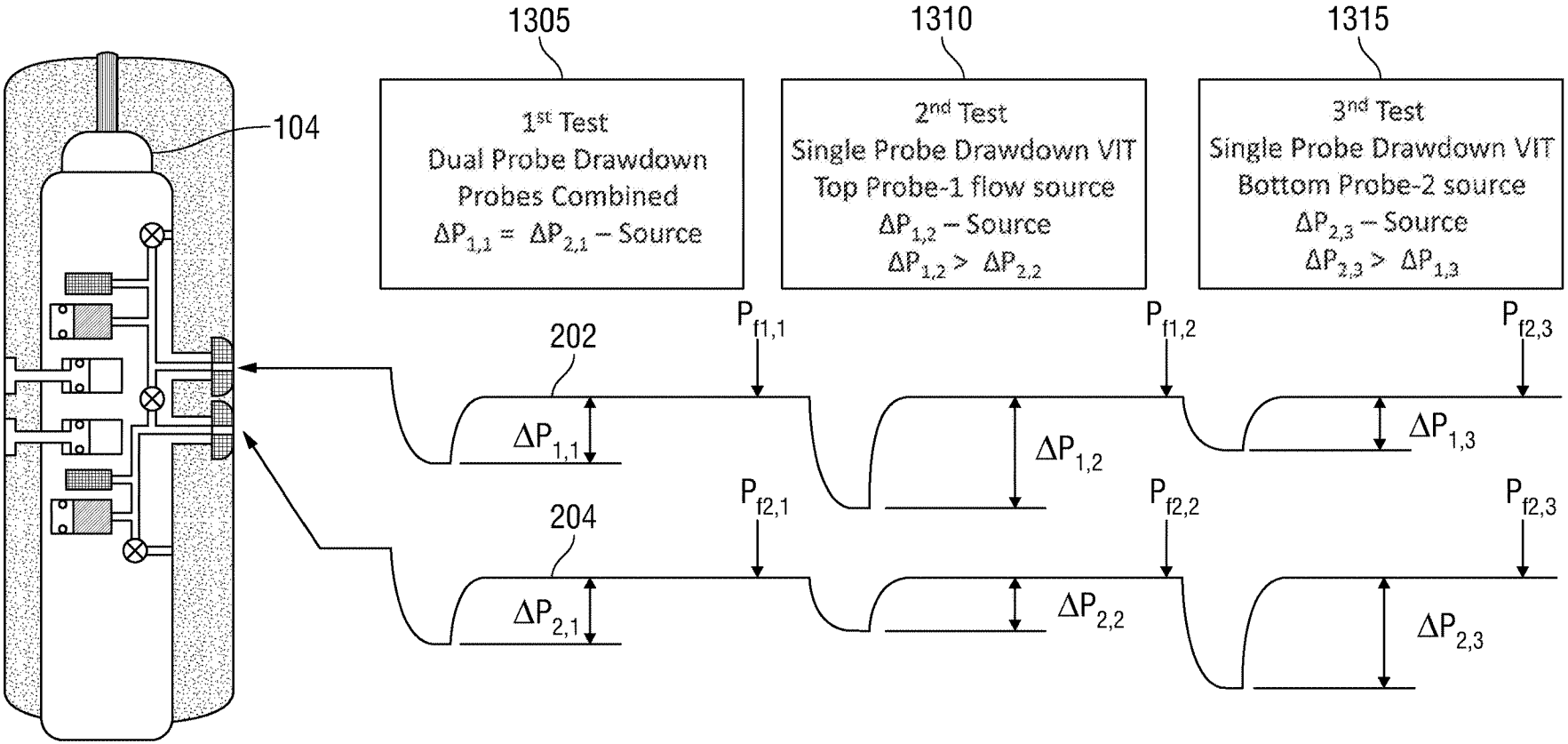
FIG. 2 illustrates one embodiment of a typical dual probe tester's pressure testing sequence where three pressure tests are performed with a single drawdown and buildup pulse. In some embodiments, the pressure data can be monitored for each probe and is illustrated by the curves and with the magnitude of the drawdown to buildup pressure differential measurements.

One of the objectives of testing a formation is to determine the mobility, permeability, permeability anisotropy and formation pressure. The pressure testing method for a two-probe tool is illustrated in FIG. 2 where the pressure measurements versus time for each of the probes are illustrated by the two curves 202 and 204, as well as corresponding curves 302 and 304 in FIG. 3. The curves illustrate the pressure responses in a testing sequence with three pressure tests. One aspect of the present invention that is distinguished over the prior art is the use of probes of different geometries.

This type of pressure testing is called a pretest since it is a relatively short duration (typically 5-20 minutes) and used to make initial estimates of the formation mobility and pressure. In the first pretest, flow is produced from both probes to establish communication with the formation. As shown, the pressure is reduced from the wellbore hydrostatic to a pressure below formation pressure. When the flow from the formation stops the pressure increases or builds up and stabilizes at a pressure close to formation pressure. In the second and third tests flow is produced from one of the probes creating a pressure drop and a subsequent buildup. Pressure changes are recorded from the second probe which are caused by the pressure in the formation surrounding the probe being reduced and measured at a distance from the source probe. This type of pressure testing is called an interference test and can be used to measure a directional component of permeability between the probes.

Subsequent testing could involve sampling or longer duration pressure testing for more definitive analysis such as determining formation skin damage, horizontal or radial permeability and anisotropy. These extended testing methods involve creating a suitable pressure transient that can be used to delineate these parameters. However, the operational constraints of the formation tester can limit its ability to create a sufficient pressure transient over a wide range of formation conditions. Typically, formation testers are limited to a range of permeability from 1 to 100 md to create a definitive pressure transient which can be recorded with sufficient accuracy and resolution to interpret the transient results. Well bore effects such as invasion and pressure noise from mud pumps, in the case of testing while drilling, can adversely limit a definitive interpretation of the transient pressure data.

As shown in FIGS. 1*a*-1*b*, probes 108 are typically extended from the testing tool 104 to the borehole 102 with the aid of hydraulic rams 110 to create a sealing communication with the formation. The initial pressure test reduces the pressure from the wellbore hydrostatic to below the formation pressure by moving the test pump piston 118 which withdraws fluid from the formation through the probe aperture 116. This can be done from each probe or simultaneously from both probes as shown by the first pressure test 1305 in FIG. 2.

Formation intervals typically have bedding planes where deposition creates a permeability anisotropy perpendicular to the bedding plane. In this case a homogeneous formation is assumed such that the well bore is oriented orthogonally to the bedding plane. The horizontal permeability $k_h$ (md) is generally aligned along the bedding plane and assumed to be the same in all directions of that plane (x and y coordinates in the plane) and the vertical permeability $k_v$ (md) is orthogonal to the bedding plane (z relative coordinate). During the pressure testing sequence the pressures and flow rate transient data is recorded and used to determine the spherical permeability $k_s$ (md) and or mobility $M_s$(md/cp) from a single probe, as shown in U.S. Pat. No. 7,059,179 using the following relationship:

$$M_s = \frac{k_s}{\mu} = (1+S)C_{ps}(\lambda)\frac{Q}{\Delta P}p_{Ds}(C_D,\ S_D,\ t_D,) \tag{1}$$

Where the following parameters are denoted:

$k_s$ formation spherical permeability millidarcy $$\left(k_s = \sqrt[3]{k_v k_h^2}\ md\right)$$

$\lambda$ permeability or mobility anisotropy ($\lambda = k_v/k_h = M_v/M_h$, non-dimensional)

$\mu$ fluid viscosity centipoise (cp)

$M_s$ formation mobility in millidarcy per centipoise (md/cp)

S wellbore skin damage (non-dimensional)

Q probe flow rate ($cm^3$/sec)

$\Delta P$ pressure change (psi)

$C_{ps}$ probe coefficient for spherical permeability (md–psi/$cm^3$/sec)

$p_{Ds}$ dimensionless pressure transient for spherical permeability $C_D$ dimensionless storage $S_D$ dimensionless skin $t_D$ dimensionless time The spherical permeability or mobility is the geometric mean of the vertical and horizontal components as denoted. The probe size and shape normally have the greatest effect on the $C_{ps}$ probe coefficient. The probe coefficient can be determined using analytical or numerical simulations, as shown in U.S. Pat. No. 7,059,179 and publications including SPE-183791 and SPWLA 2016-V. Additional parameters that can affect the $C_{ps}$ are the anisotropy, borehole diameter, formation bed boundaries, relative dip angle and azimuthal position of the probe in the borehole. These effects are shown with an analytical model in SPE-183791 but numerical simulation can also be used to improve the accuracy, as shown in SPWLA2016-V.

As illustrated in FIGS. 1*a*-1*b*, the probe normally comprises a simple circular opening 108 but oval or elongated shaped probes 112 are also employed. Additionally, other shapes could be used to enhance the testing sensitivity to the parameters of most interest, as shown in U.S. Pat. No. 5,279,153. In the following example, circular probes in a vertical wellbore with a horizontal formation bed and infinite bed boundaries are assumed to demonstrate the typical testing methods and limitations.

It is desirable for the pressure to stabilize during the drawdown and buildup, as shown in FIG. 2. This stabilizing condition is known as infinitely acting steady-state spherical flow. In these conditions the dimensionless pressure transient $p_{Ds}$ becomes 1, which significantly simplifies Eq. 1. Formation testers can create the infinitely-acting steady-state condition in the relatively short duration pretests making the basic determination of spherical permeability or mobility relatively straight forward. For lower permeability formations (i.e., >1 md) it may not be possible to create the steady-state conditions. However, there are well-known techniques in the industry used to estimate the steady-state response in unsteady conditions. Some of the methods are shown in the U.S. Pat. Nos. 5,602,334, 6,478,0961 and journal paper SPE-143302-PA.

As shown in FIG. 2, the pressure differentials recorded for the first probe are $\Delta P_{1,1}$, $\Delta P_{1,2}$, and $\Delta P_{1,3}$ for the three pretests illustrated by curve 202. The pressure differentials for the second probe are $\Delta P_{2,1}$, $\Delta P_{2,2}$, and $\Delta P_{2,3}$ and illustrated by curve 204. The pressure measurements at the end of each pressure stabilization are recorded as an estimate of the formation pressure, shown in FIG. 2, for the first probe as $P_{f1,1}$, $P_{f1,2}$, and $P_{f\ 1,3}$ and for the second probe as $P_{f2,1}$, $P_{f2,2}$, and $P_{f2,3}$.

An alternative method to a single pressure drawdown buildup pulse is to generate a pressure wave by reciprocating a piston 118 which is transmitted to the formation by one or both probes. This method is shown for a dual probe tool in SPE-64650 and U.S. Pat. No. 5,672,819 and illustrated in FIG. 3. In this embodiment, the probe coefficients are determined for the oscillating pressure wave for a specific wave frequency. The steady-state version of Eq. 1 can be used in the same manner by using the pressure magnitude of the pressure wave for the pressure differential ΔP, see FIGS. 3, 302 and 304. However, now the probe coefficients would have a frequency dependency. The steady-state could be assumed to have a frequency of 0. As shown in SPE-64650 and U.S. Pat. No. 5,672,819 low permeability formations are more responsive to lower frequency pressure waves.

In several embodiments, the piston 118 must move in a similar wave pattern to produce the pressure wave at the probes. A phase shift between the piston movement and the pressure wave can also be used to estimate the mobility. In the case of an interference test, the phase shift from the wave at the source and monitoring probe can be used to estimate the directional mobility between the probes. The method and tools for testing and of estimating formation properties can be used in the invention as an alternate to the steady-state estimates.

Using the steady-state version of Eq. 1 for the first pressure test shown in FIG. 2, where flow is produced from both probes, the following simplified Eqs. 2 and 3 would be used for probe 1 and 2 respectively:

$$M_{s1,1} = (1+S)C_{ps1}(\lambda)\frac{Q_{1,1}}{\Delta P_{1,1}} \tag{2}$$

$$M_{s2,1} = (1+S)C_{ps2}(\lambda)\frac{Q_{2,1}}{\Delta P_{2,1}} \tag{3}$$

Where the following parameters are denoted:

$M_{s1,1}$ $1^{st}$ probe, $1^{st}$ test spherical mobility in millidarcy (md/cp)

$M_{s2,1}$ $2^{nd}$ probe, 1st test spherical mobility in millidarcy (md/cp)

$Q_{1,1}$ $1^{st}$ probe, $1^{st}$ test flow rate ($cm^3$/sec)

$Q_{2,1}$ $2^{nd}$ probe, $1^{st}$ test flow rate ($cm^3$/sec)

$\Delta P_{1,1}$ $1^{st}$ probe, $1^{st}$ test pressure change (psig)

$\Delta P_{2,1}$ $2^{nd}$ probe, $1^{st}$ test pressure change (psig)

$C_{ps1}$ $1^{st}$ probe coefficient for spherical permeability (md–psi/$cm^3$/sec)

$C_{ps2}$ $2^{nd}$ probe coefficient for spherical permeability (md–psi/$cm^3$/sec)

Assuming the flow is from one source or pump and the probes are hydraulically coupled, Eqs. 1 and 2 can be combined using the principle of mass conservation. Consider the total flow rate $Q_{t,1}$ from both probes which can be expressed as follows:

$$Q_{t,1} = Q_{1,1} + Q_{2,1} = \frac{M_{s1,1}\Delta P_{1,1}}{(1+S)C_{ps1}(\lambda)} + \frac{M_{s2,1}\Delta P_{2,1}}{(1+S)C_{ps2}(\lambda)} \tag{4}$$

Assuming the formation is homogeneous and identical probes are use the formula can be simplified as follows:

$$Q_{t,1} = \frac{M_{s1-2,1}\Delta P_{1-2,1}}{(1+S)} - \left(\frac{1}{C_{ps1}(\lambda)} + \frac{1}{C_{ps2}(\lambda)}\right) \tag{5}$$

Where the following parameters are denoted:

$M_{s1-2,l}$ probes 1 and 2, $1^{st}$ test combined spherical formation mobility (md/cp)

$\Delta p_{1-2,1}$ probes 1 and 2, $1^{st}$ test combined pressure change (psig)

Assuming the probes are identical in geometry, then a combined probe coefficient $C_{ps1-2}$ can be estimated as follows:

$$M_{s1-2,1} = (1+S)\frac{C_{ps1-2}(\lambda)}{2}\frac{Q_{t,1}}{\Delta P_{1-2,1}} \tag{6}$$

The actual $C_{ps1-2}$ is slightly lower than this estimate due to flow interference between the probes which depends on the probe separation, but it can be determined analytically or estimated with numerical simulations. In addition, the combined probe coefficient $C_{ps1-2}$ variance due to anisotropy is also very close to a single circular probe. Probe coefficient functions are shown in FIG. 5 for a circular 502 and an oval probe 504 as a function of anisotropy.

In order to determine the spherical permeability from Eq. 6, the skin S and anisotropy must be known or assumed. The skin damage is due to drilling activity reducing the permeability near the wellbore wall, primarily from drilling fluids containing small particles which are being deposited into the rock pores and the drilling fluids modifying the rock and permeability near the wellbore. This damage typically occurs within a fraction of an inch of the wellbore wall, but can have a substantial effect on the mobility or permeability estimate. The anisotropy can also influence the spherical mobility estimate, but typically to a lesser degree and is normally assumed to be isotropic (i.e., λ=1).

In the second and third pressure tests shown in FIG. 2, an interference test is performed by flowing from one of the probes while monitoring the other. In this case the following equations can be used to estimate the spherical and horizontal mobility:

$$M_{s1,2} = (1+S)C_{ps1}(\lambda)\frac{Q_{1,2}}{\Delta P_{1,2}} \tag{7}$$

$$M_{h2,2} = C_{ph1}(\lambda)\frac{Q_{1,2}}{\Delta P_{2,2}} \tag{8}$$

Where the following parameters are denoted:

$M_{s1,2}$ $1^{st}$ probe, $2^{nd}$ test spherical mobility in millidarcy (md/cp)

$M_{h2,2}$ $2^{nd}$ probe, $2^{nd}$ test horizontal mobility in millidarcy (md/cp)

$\Delta P_{1,2}$ $1^{st}$ probe, $2^{nd}$ test pressure change (psig)

$\Delta P_{2,2}$ $2^{nd}$ probe, $2^{nd}$ test pressure change (psig)

$Q_{1,2}$ $1^{st}$ probe, $2^{nd}$ test flow rate ($cm^3$/sec)

$C_{ph2}$ $1^{st}$ to $2^{nd}$ probe coeff. for horizontal permeability (md–psi/$cm^3$/sec)

In a similar manner to Eq. 6, determining the spherical mobility from the 2nd test 1310 using Eq. 7 requires that the skin S and anisotropy λ must be known or assumed. The horizontal mobility can be determined, without skin, from the data recorded on the second probe, as shown in U.S. Pat. No. 7,059,179 by Eq. 8. However, the anisotropy is still unknown and must be assumed. It is apparent that even though the probe orientation is most sensitive to the horizontal mobility in this case, it is still dependent on the vertical permeability as reflected by the anisotropy in the probe coefficient. The theory typically assumes a point source in an infinite space and when the well bore and probe geometry is considered, the test results must consider the anisotropy. This is demonstrated by the paper SPE-183791 with an analytical model that determines the probe coefficient that considers the probe geometry, wellbore size, orientation and other factors. As mentioned previously, numerical models can also be used to calibrate the probe coefficient $C_{ph2}$.

Methods of using the buildup transient data to determine the skin S is well known and shown in U.S. Pat. No. 7,059,179 and other publications. If the skin S can be accurately determined, then the anisotropy can be determined from Eqs. 8 and 9. However, as mentioned previously, skin determination using late time transient data is limited to a narrow range of operational conditions and is dependent on the tester capabilities and may not be definitive.

A third pressure test 1315 is not required but the information can yield additional information regarding the formation heterogeneity. If the formation is homogeneous then Eqs. 9 and 10 should yield similar results as Eqs. 8 and 9.

$$M_{s2,3} = (1+S)C_{ps2}(\lambda)\frac{Q_{2,3}}{\Delta P_{2,3}} \tag{9}$$

$$M_{h1,3} = C_{ph2}(\lambda)\frac{Q_{2,3}}{\Delta p_{1,3}} \tag{10}$$

Where the following parameters are denoted:

$M_{h1,3}$ $1^{st}$ probe, $3^{rd}$ test horizontal mobility in millidarcy (md/cp)

$M_{s2,3}$ $2^{nd}$ probe, $3^{rd}$ test spherical mobility in millidarcy (md/cp)

$\Delta P_{1,3}$ $1^{st}$ probe, $3^{rd}$ test pressure change (psig)

$\Delta P_{2,3}$ $2^{nd}$ probe, $3^{rd}$ test pressure change (psig)

$Q_{2,3}$ $2^{nd}$ probe, $3^{rd}$ test flow rate ($cm^3$/sec)

$C_{ph2}$ $2^{nd}$ to $1^{st}$ probe coeff. for horizontal permeability (md−psi/$cm^3$/sec)

If the results from tests 2 and 3 are dissimilar, then it can be assumed the probes are measuring two different bedding layers with different properties. This can also be determined by comparing the results from tests 1 and 2. If large differences are determined, then a two-layered model must be considered. One example of this is shown in U.S. Pat. No. 7,224,162 where an upscaled anisotropy can be determined considering a two-layered model. However, the skin S is still required to estimate the mobility and anisotropy of each layer and the main limitation for the prior art discussed in this example.

Figure 4A:
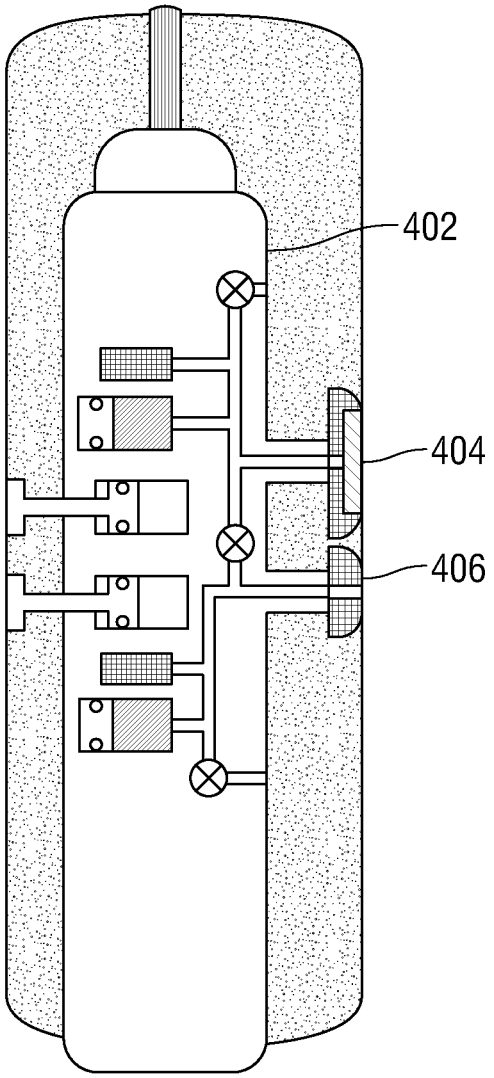
FIG. 4*a* illustrates one embodiment of the invention inside view.
Figure 4B:
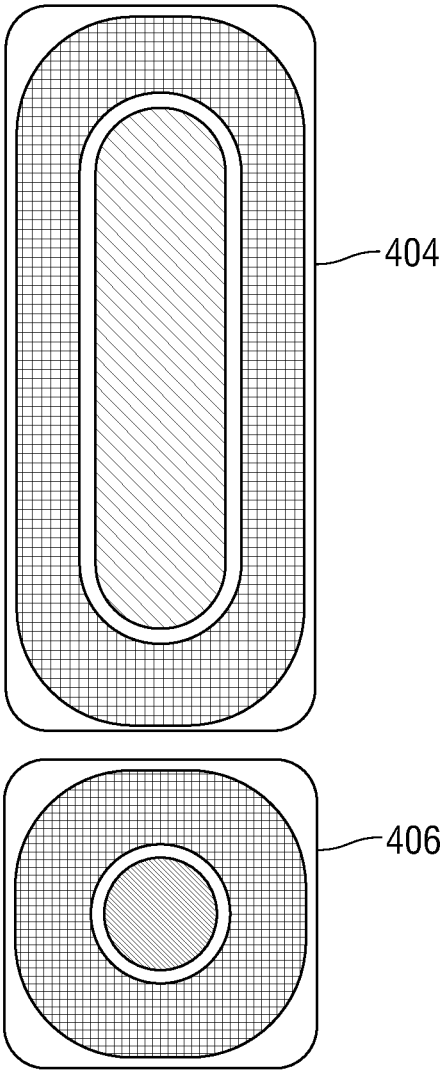
FIG. 4*b* illustrates one embodiment of the with an oval shaped probe and a circular probe for pressure testing an earth formation.

Embodiments of this invention is shown in FIGS. 4*a* and 4*b* which have two differently shaped probes with a circular probe 406 and an oval elongated probe 404 for the second probe. From the paper SPE-183791, the probe coefficient for the circular probe in a well bore perpendicular to the bedding plane can be estimated by the analytical expression where the anisotropy is less than or equal to one ($\lambda \leq 1$):

$$C_{ps1}(r_p, r_w, \lambda) = 920.84\frac{K(\sqrt{1-\lambda})C_{eff}(r_p/r_w, \lambda)}{r_p\sqrt[3]{\lambda}} \tag{11}$$

Where the following parameters are denoted:

K is the complete elliptic integral of modulus $\sqrt{1-\lambda}$ $r_p$ is the $1^{st}$ circular probe radius (in)

$r_w$ wellbore radius (in)

Figure 5A:
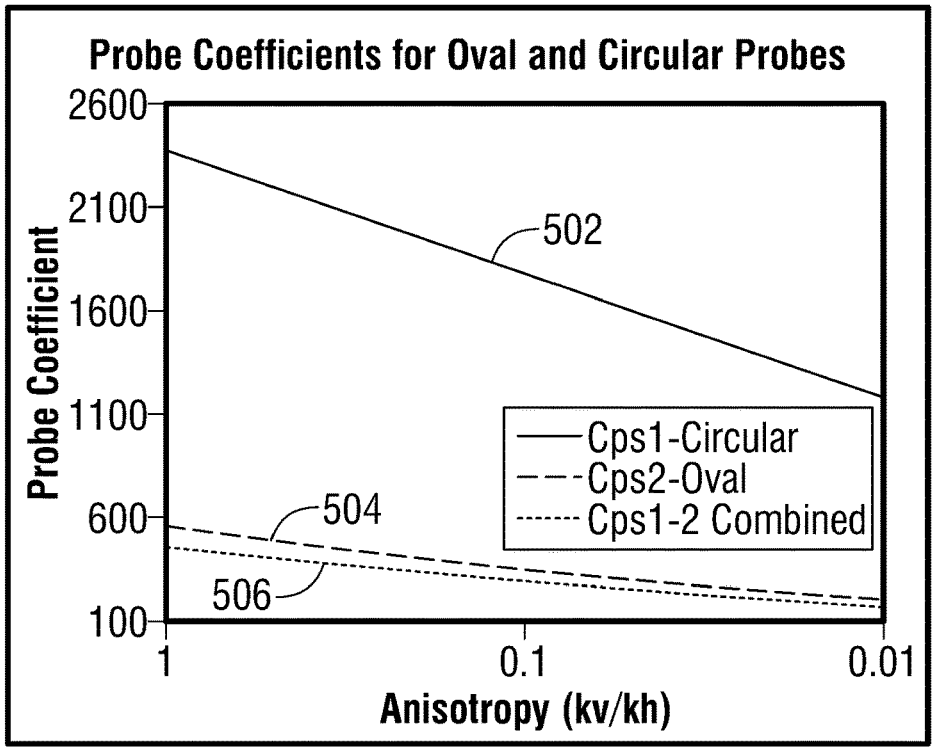
FIG. 5*a* illustrates one embodiment of the flow shape factor responses of two probes showing how a circular probe has a substantially different response to anisotropy than an oval probe.
Figure 5B:
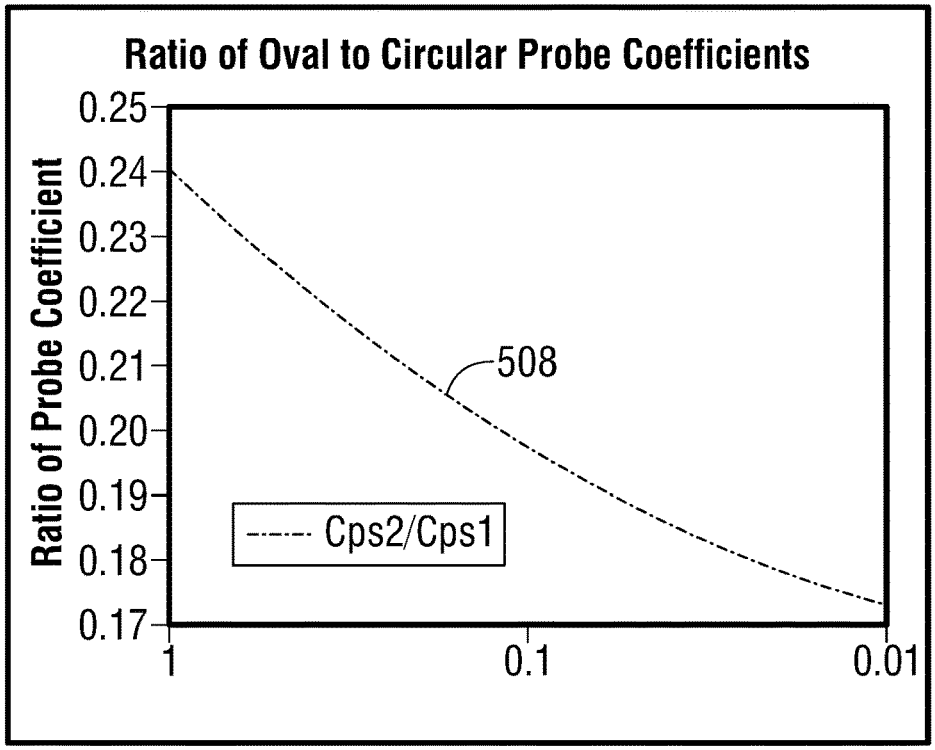
FIG. 5*b* illustrates one embodiment of the present invention showing the ratio of the oval probe to the circular probe. When the circular and oval probes are combined for testing, the curve shows a similar response to the dominant oval probe curve.

This function is plotted in FIGS. 5*a*-5*b* as a dashed line 502 representing the function $C_{ps1}(\lambda)$ with a fixed probe radius and wellbore radius. The oval probe 406 coefficient curve $C_{ps2}(\lambda)$ 504 is shown in FIGS. 5*a*-5*b* which is derived from the analytical model in SPE-183791. Additionally, a third probe shape can be made by combining the two probes, creating an additional probe shape function $C_{ps1\text{-}2}(\lambda)$, shown by curve 506 in FIG. 5. Notice the combined probe shape function 506 is very similar to the larger dominant oval shaped probe 504. Testing by flowing from the two probes is typically performed in the first test sequence to establish hydraulic communication with both probes before performing an interference test from either probe, as shown in FIG. 2. The following embodiment demonstrates a method using interference tests from both probes, and this invention also discloses how combined probes can be used.

Consider Eqs. 7 and 9 that determine the spherical mobility from each probe. If it is assumed the formation is homogeneous, then the mobilities are the same for both probes, and it is possible to solve for the anisotropy, if the probe shape functions have different variances to anisotropy, as shown in FIG. 5*a*-5*b*. In FIG. 5*b*, a curve 508 that is new and can only be created if there is a difference in geometry in the two probes.

$$M_{s1,2} = M_{s2,3} = (1+S)C_{ps1}(\lambda)\frac{Q_{1,2}}{\Delta P_{1,2}} = (1+S)C_{ps2}(\lambda)\frac{Q_{2,3}}{\Delta P_{2,3}} \tag{12}$$

It can be noted that the skin would be factored out of these equations which simplifies the function as follows:

$$C_{ps1/2}(\lambda) = \frac{C_{ps1}(\lambda)}{C_{ps2}(\lambda)} = \frac{\Delta P_{1,2}}{Q_{1,2}}\frac{Q_{2,3}}{\Delta P_{2,3}} \tag{13}$$

The ratio of the two probe flow coefficients creates a new function to solve for the anisotropy, which is shown as dashed-dot curve 508 in FIG. 5. Standard regression techniques can be used to solve for the anisotropy using equation 12 or 13. Alternatively, an approximate function can be fitted to curve 508. Consider the power function:

$$C_{ps1/2}(\lambda) = a\lambda^b = \frac{\Delta P_{1,2}}{Q_{1,2}}\frac{Q_{2,3}}{\Delta p_{2,3}} \tag{14}$$

Now the anisotropy can be solved directly.

$$\lambda = \sqrt[b]{\frac{1}{a}\frac{\Delta P_{1,2}}{Q_{1,2}}\frac{Q_{2,3}}{\Delta P_{2,3}}} \tag{15}$$

Alternatively, the two probe flow functions can be approximated and simplified for the particular formation tester probe geometry and wellbore size.

$$C_{ps1}(\lambda) = a_1 + b_1 \ln(\lambda) \tag{16}$$

$$C_{ps2}(\lambda) = a_2 + b_2 \ln(\lambda) \tag{17}$$

Substituting Eqs. 16 and 17 into Eq. 13 also makes a direct solution possible as shown:

$$\lambda = e^{-\left(\frac{a_2\frac{Q_{2,3}}{\Delta P_{2,3}} - a_1\frac{Q_{1,2}}{\Delta P_{1,2}}}{b_2\frac{Q_{2,3}}{\Delta P_{2,3}} - b_1\frac{Q_{1,2}}{\Delta P_{1,2}}}\right)} \tag{18}$$

It is now possible to solve for the horizontal mobility using Eq. 8 and or 10 (i.e., $M_{h2,2}$ and $M_{h1,3}$) by using the anisotropy λ determined from Eq. 15 or 18 and the interference test probe flow coefficient functions $C_{ph1}(\lambda)$ and $C_{ph2}(\lambda)$. Now using the anisotropy and horizontal mobility, the spherical mobility is determined as follows:

$$M_{s1,2} = \sqrt[3]{M_v M_{h2,2}^2} = \sqrt[3]{\lambda M_{h2,2}^3}\text{, or } M_{s2,3} = \sqrt[3]{\lambda M_{h1,3}^3}\text{,} \tag{19}$$

Using the spherical mobility and Eqs. 7 and 9, the skin is determined as follows:

$$S_{1,2} = \frac{M_{s1,2}}{C_{ps1}(\lambda)}\frac{\Delta P_{1,2}}{Q_{1,2}} - 1\text{, or } S_{2,3} = \frac{M_{s2,3}}{C_{ps2}(\lambda)}\frac{\Delta P_{2,3}}{Q_{2,3}} - 1 \tag{20}$$

The two solutions for skin could have different values due to formation heterogeneity which would be evident from Eq. 20. Additionally, the spherical mobilities could have different values for the same reason. Because the problem is now overdetermined with 4 equations and 3 unknowns, statistical regression techniques can be used to make the best statistical fit to the equations and the standard deviations would indicate the degree of heterogeneity and uncertainty in the measurement.

More relationships can be determined by including the first pretest which produces from both probes. As shown in Eq. 6, the two probes act together to create a third probe shape with a unique probe flow coefficient $C_{ps1\text{-}2}$ which is illustrated in FIGS. 5*a*-5*b* with the dotted curve 506. Now Eq. 6 can be combined with Eqs. 7 and 8 or 9 and 10 in a similar manner done with Eqs. 12 to 20, creating additional solutions for the anisotropy, spherical permeabilities and skin. There are now 5 equations and 3 unknowns making the solution even more overdetermined. If additional tests are performed from both probes or as interference tests, there is more data available to improve the confidence in the testing results. Alternatively, it may be desirable to save time by just performing the first two tests making it possible to determine the three parameters using the three Eqs. 6, 7 and 8.

Assuming all three tests are performed, it is possible to introduce additional parameters. For example, a two-layered system could be assumed where $M_{s1,2}$ and $M_{s2,3}$ are the spherical mobilities for each layer and each layer has a different skin (i.e., $S_{1,2}$ and $S_{2,3}$). This adds two additional variables making it possible to estimate all 5 variables using Eq. 6 thru 10 employing the methods shown previously.

The analytical models used in this first embodiment presented are approximate. More accurate functions can be developed using numerical methods such as those shown in the paper SPWLA-2016-V. The results from numerical models can be used in a similar manner to the methods shown previously. In the art of formation testing simulation, it is well known that both analytical and numerical models can include additional formation conditions such as horizontal wells with probes oriented azimuthally, dipping beds with probes oriented azimuthally, bed boundaries, multiple bedding planes, etc. Some analytical models can be used to estimate these conditions as shown in the SPE-181445 paper. However, there are limitations to the extent that analytical models can be used.

Alternatively, a library of numerical simulations can be created for a range of conditions and used to characterize the probe coefficients. The probe coefficients vary due to the geometry of the testing conditions and are independent to properties such as permeability and skin. Permeability anisotropy is a geometric consideration as has been demonstrated by many publications and in the first embodiment presented. The library would include the additional geometric conditions such as bedding planes' size and position, well bore orientation and probe positioning within the wellbore. It is normally assumed that the anisotropy is oriented with the bedding plane, but this is not a limitation to this invention. The anisotropy tensor can also be varied and oriented in any direction if desired to further enhance the measurement.

When a test condition is encountered, a specific formation and wellbore geometry can be calibrated for the probe shape function that includes well bore bed boundaries and relative bed dipping angles, in addition to the anisotropy. These variables can be searched in the simulation library to find the closest match for the probe coefficients for one or more of the properties required. Alternatively, a multivariant, neural network or perturbation analysis methods can be developed from this data base that would interpolate between the wide ranges of conditions to accurately estimate the probe flow coefficients for the testing case required.

In another embodiment of the invention, these geometric properties could be included in the regression to further enhance the analysis. For example, if additional measurements are made in the bore hole at various depths and orientations, all of the data could be used to determine dip angles, bed boundaries and the anisotropy tensor. This could also be accomplished by using a formation testing tool that incorporates more than two probes of various shapes and orientations.

Figure 6A:
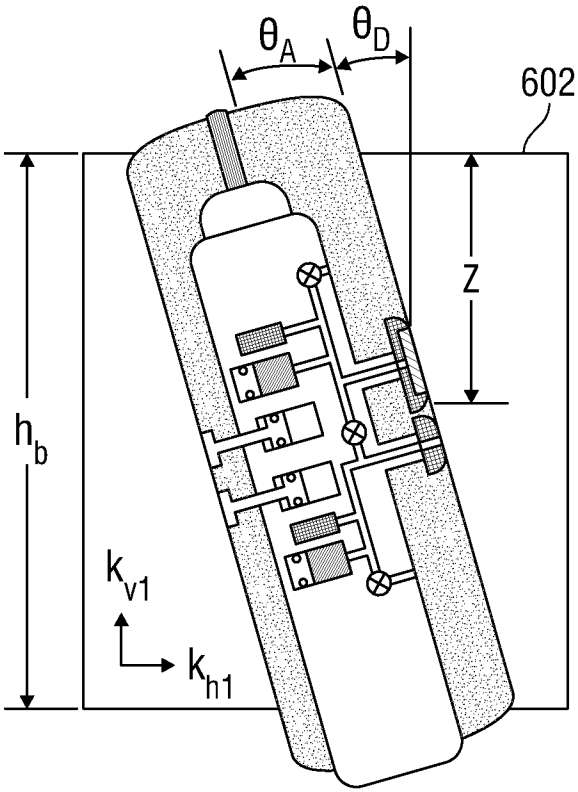
FIG. 6*a* illustrates one embodiment of the formation conditions encountered including the well bore being dipped at an angle $\phi_D$ relative to the bedding plane and an azimuthal angle $\phi_A$ relative to the orientation of the probe(s) around the well bore with first formation condition shown is for a single bedding plane with boundaries.
Figure 6B:
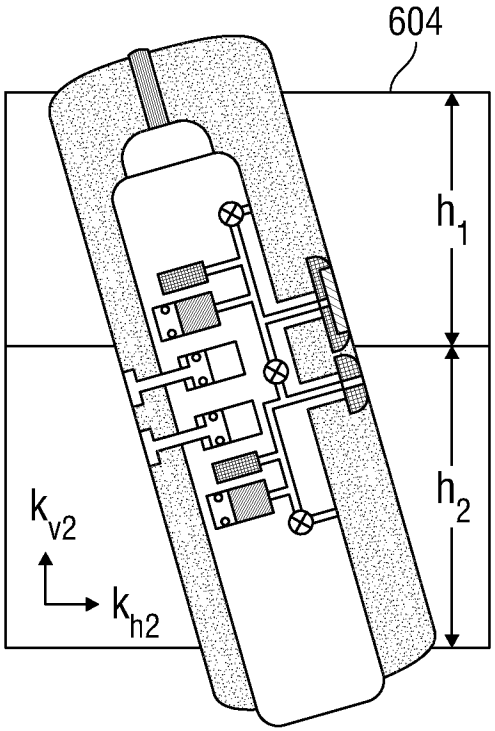
FIG. 6*b* illustrates one embodiment of the formation conditions encountered including the well bore being dipped at an angle $\phi_D$ relative to the bedding plane and an azimuthal angle $\phi_A$ relative to the orientation of the probe(s) around the well bore with a single bedding plane with two formation beds.
Figure 6C:
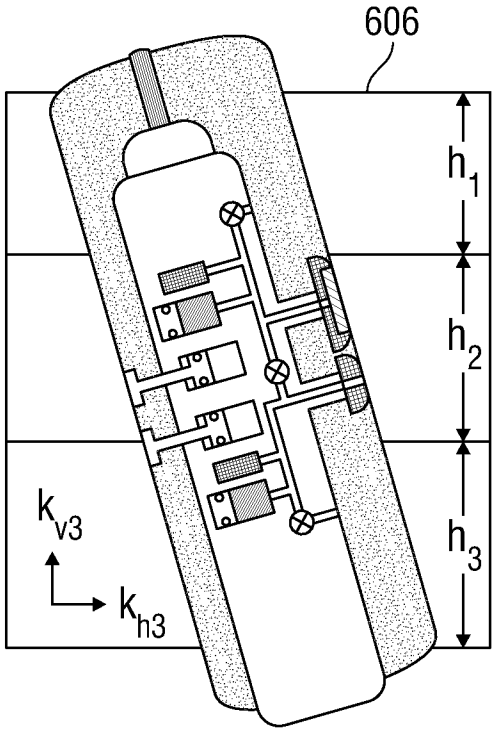
FIG. 6*c* illustrates one embodiment of the formation conditions encountered including the well bore being dipped at an angle $\phi_D$ relative to the bedding plane and an azimuthal angle $\phi_A$ relative to the orientation of the probe(s) around the well bore with three formation beds.

FIGS. 6*a*-6*c* illustrates three types of formation conditions: single formation bedding plane with boundaries 602, two formation beds intersecting near the probes 604, and three formation bedding planes 606. The invention is not limited to these three conditions but are shown to illustrate some of the variables that can affect the probe coefficients. In the single bed example 602 the tool borehole is tilted at a dipping angle $\theta_D$ relative to the bedding plane. The tool can also be rotated relative to the bore hole at an azimuthal angle $\theta_A$ relative to a reference position. The bedding plane has a total height h and the tool is position relative to the top of the bed by the Z dimension as shown in formation 602. In this case a probe would have a coefficient that includes these variables in addition to anisotropy:

$$C_{ps(n)}(r_D, f, \lambda, \theta_D, \theta_A, h_D, \beta_1, \beta_2, Z_D) \tag{21}$$

$$C_{pp(m)}(r_D, f, \lambda, \theta_D, \theta_A, h_D, \beta_1, \beta_2, Z_D) \tag{22}$$

Where the following parameters are denoted:

$C_{ps}(n)$ source-probe coefficient of the probe number (1, 2, . . . n)

$C_{pp}(m)$ probe-to-probe coefficients (1, 2, . . . m)

$r_D$ dimensionless probe radius ($r_s/r_w$)

f frequency of pressure wave (Hz, 0 represents a single drawdown).

$\theta_D$ relative dip angle (deg)

$\theta_A$ relative azimuthal angle (deg)

$h_D$ dimensionless formation bedding plane height ($h_s/r_w$)

$\beta_1$ formation top layer boundary condition (0-1 or pressure-1)

$\beta_2$ formation bottom layer boundary condition (0-1 or pressure-2)

$Z_D$ dimensionless tool position from top of formation bed ($Z/h_t$)

The source-probe coefficient $C_{ps(n)}$ represents the probe coefficient where flow is withdrawn at a rate $Q_{sp(n)}$ from the formation generating the infinitely-acting steady-state pressure differential $\Delta p_{sp(n)}$. This probe coefficient can also represent a combination of probes used to create an effective geometry where flow is withdrawn from both probes, as shown in the first test 1305 of FIG. 2. Therefore, with two probes it is possible to have three source probe geometries and corresponding coefficients. The probe-to-probe coefficient $C_{pp(n)}$ is used with the pressure differential at a non-flowing observation probe $\Delta p_{sp(n)}$, similar to tests two 1310, 1410 and three 1315, 1415 illustrated in FIGS. 2 and 3. While not shown in this example the probe-to-probe coefficient can be determined considering the relative or differential flow rates from both probes. With two probes it is possible to have three source probe coefficients and two or more probe-to-probe coefficients. As the number of probes increases the source-probe and probe-to-probe coefficients increase geometrically. However, not all combinations would necessarily be beneficial, and would depend on the specific geometries chosen and formation conditions.

With more complex formation geometries, nondimensional variables can be introduced to reduce the total number of probe coefficients required in the simulation library. The bedding plane height can be nondimensionalized by using the ratio of formation height to well bore radius ratio ($h_D=h_s/r_w$). A relative depth position can be defined as the dimensionless ratio of the depth Z to formation height ($Z_D=Z/h_t$). The dimensionless probe radius is the ratio of the equivalent source radius by the well bore radius (i.e., $r_s/r_w$) where the equivalent source radius can be defined as a function of the probe opening area ($A_p$):

$$r_s = \sqrt{\frac{A_p}{\pi}} \tag{23}$$

As shown in FIGS. 6*a*-6*c*, the anisotropy (i.e., $\lambda=k_v/k_h$ or $M_v/M_h$) is aligned to the bedding plane which is normally assumed but is not a limitation to this invention. The bedding planes can also have boundary conditions at the top and/or bottom such as a no flow (i.e., 0) or open to fluid flow (i.e., 1) at a constant pressure which are additional variables shown in Eq. 21. In the first embodiment of this invention the bed boundaries are considered infinite or out of the range of sensitivity to the probes. However, there can still be a relative dip and azimuthal angle when infinite boundaries are assumed.

In the second formation 604 shown in FIG. 6*b* there are two bedding planes with the dimensions $h_1$ and $h_2$. The top and bottom of these bedding planes can also have boundary conditions. The bedding planes are shown to meet between the probes but that is not a requirement and the relative depth position is specified by Z. It is understood that the relative position can also be specified along the well bore relative to the bed boundaries. Where the beds meet together can also have a no flow or open boundary condition or a relative leakage rate (i.e., 0 to 1).

The three-layer case 606 is also shown in FIG. 6*c* with the bedding plane dimensions $h_1$, $h_2$ and $h_3$ but the number of layers may not be limited to three as will be explained. Considering the most general case, the probe coefficients could include the following variables:

$$C_{ps(n)}(r_D, f, \lambda(i), \theta_D, \theta_A, h_D(i), \alpha(i), b(i), Z_D(j)) \tag{24}$$

$$C_{pp(n)}(r_D, f, \lambda(\theta_D, \theta_A, h_D(i), \alpha(i), b(i), Z_D(j)) \tag{25}$$

Where the following parameters are denoted:

$Z_D(j)$ an array of depth positions in formation ($Z_1$, $Z_2$, . . . $Z_j$)

$h_D(i)$ an array representing the bedding planes ($h_1$, $h_2$, $h_3$, . . . $H_i$)

$\lambda(i)$ an array representing the anisotropies ($\lambda_1$, $\lambda_2$, $\lambda_3$, . . . $\lambda_i$)

$\alpha(i)$ an array representing the mobility ratios ($\alpha_1$, $\alpha_2$, $\alpha_3$, . . . $\alpha_{i-1}$)

$\beta(i)$ formation layer boundary layer condition ($\beta_1$, $\beta_2$, $\beta_3$, . . . $\beta_{i+1}$)

When multiple layers are added, the relative difference in mobility between the layers must be considered. This can be the ratio of the horizontal, vertical and/or spherical permeability between adjacent layers or a reference layer (i.e., $\alpha_i=m_i/m_\#$) where $m_\#$ is the reference layer chosen. Other methods of normalizing the layer mobility could be used, such as an upscaled mobility for all the layers. The reference layer or normalization method is selected based on the analytical or numerical modeling methods used to create the probe coefficients in the library.

Figure 3:
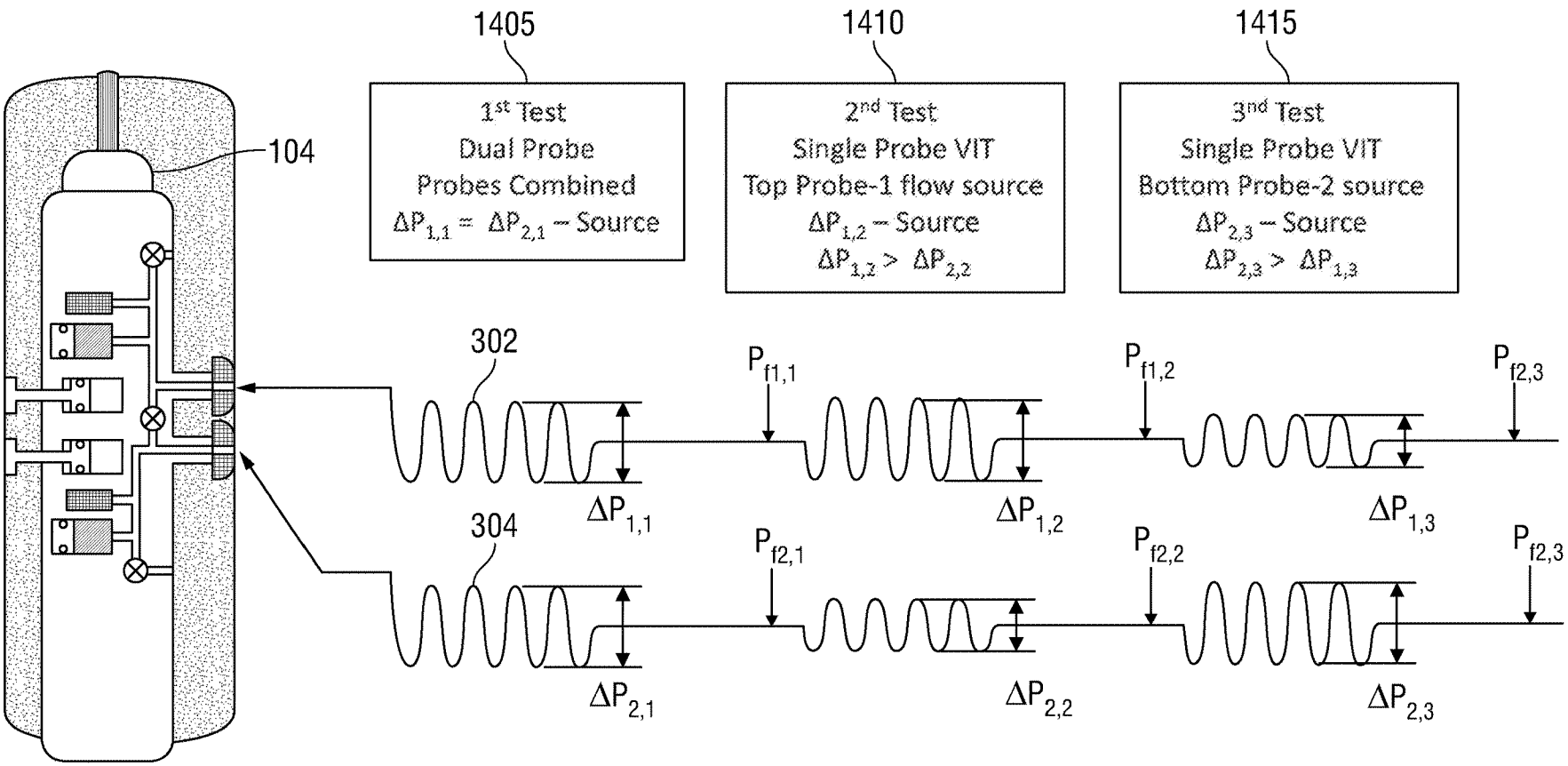
FIG. 3 illustrates one embodiment of a typical dual probe tester's pressure testing sequence where three pressure tests are performed with oscillating pressure waves. In some embodiments, the pressure data can be monitored for each probe and is illustrated by the curves and with the peak-to-peak pressure differential measurements.
Figure 7:
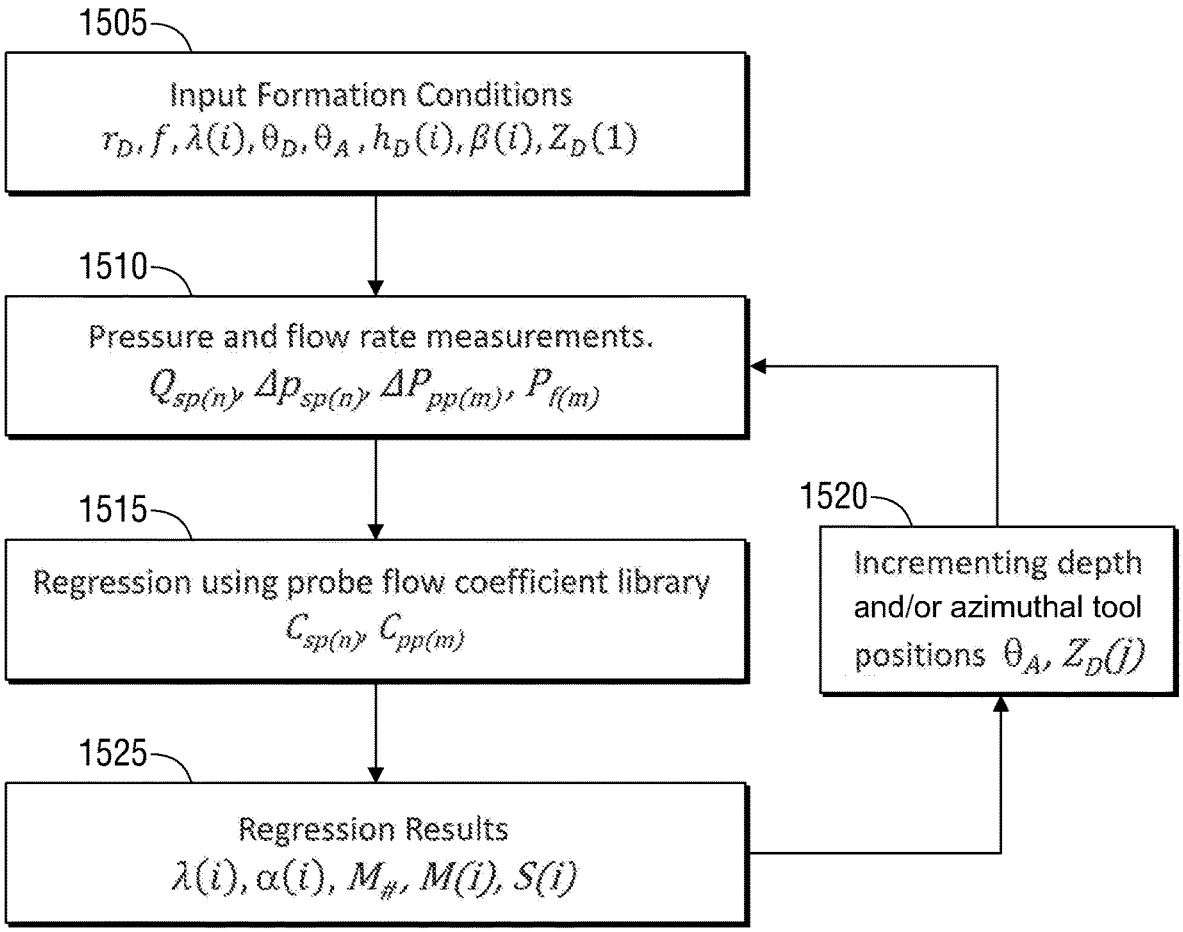
FIG. 7 illustrates one embodiment of a logic flow diagram showing the steps for determining the properties of a multi-layered formation.

A flow diagram is shown in FIG. 7 with the basic steps and logic for determining the properties of a multi-layered formation interval using the methods described previously. The first step is applying the input variables that, in this case, are the testing time, well bore size, orientation, bedding layer dimensions and boundary conditions 1505. The first step includes the initial dimensionless depth $Z_D(1)$ and azimuthal orientation angle $\theta_A(1)$ where pressure and flow rate measurements are recorded in the second step 1510. The pressure differentials and formation pressures are determined as shown in FIGS. 2 and 3. A regression can be run with the data recorded using the probe coefficient library 1515 to determine the formation properties that in this example consists of the bedding layers' spherical mobility M(i), layer skin damage S(i) and anisotropy $\lambda(i)$. Then additional measurements can be made by changing the tool location and/or orientation and can be included in the regression to improve the accuracy of the parameters derived. A regression can be run with the data recorded using the probe coefficient library in step 1515 to determine the formation properties that in this example consists of the bedding layers' spherical mobility M(i), layer skin damage S(i) and anisotropy $\lambda(i)$ as shown in step 1525. Then additional measurements can be made by changing the tool location and/or orientation as shown in step 1520. These new measurements are combined with the previous measurements in step 1510 to be included in the regression step 1515. Steps 1520 and 1515 can be repeated as needed to improve the statistical accuracy of the results shown in step 1525.

For more complex problems, additional depth locations and tool orientations may be necessary to effectively solve for additional formation properties. For example, it is possible to include additional parameters in the regression such as reservoir layer thickness, boundary conditions and relative dip angle.

Additional embodiments of this invention are shown in FIGS. 8*a*-8*c* through 12*b*. It is understood that other probe geometries can be implemented, and the invention is not limited to the ones illustrated in these figures. In several embodiments of the invention, the primary feature of the probe geometries presented is to improve the sensitivity to the testing parameters such as the relative dip angle of the wellbore, probe azimuthal orientation, multiple beds and their anisotropy, and permeability differences.

Figure 8C:
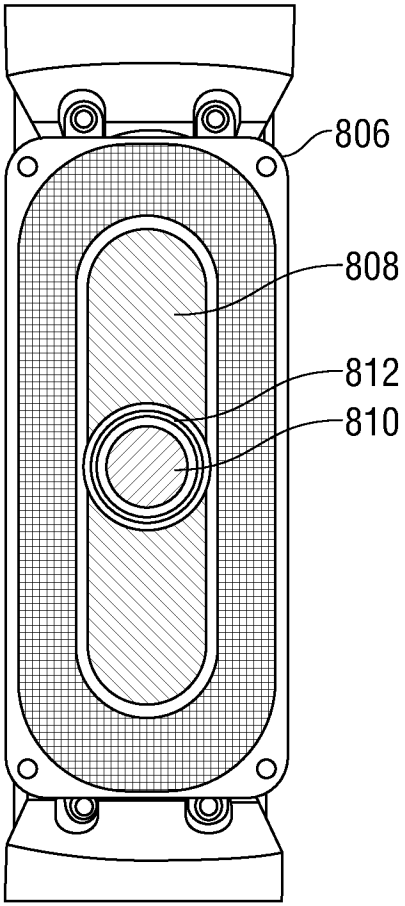
FIG. 8*c* illustrates another embodiment of the invention where the circular opening is placed inside of the oval opening.
Figure 8B:
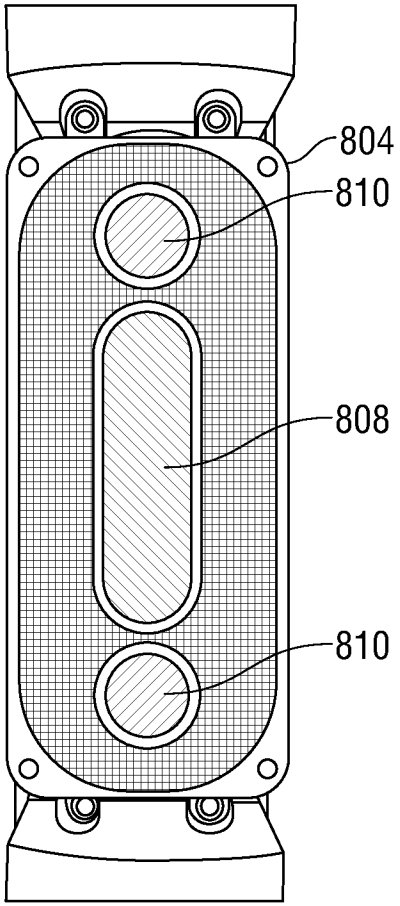
FIG. 8*b* illustrates another embodiment of the invention where a single probe contains a combination of two circular and one oval shaped openings
Figure 8A:
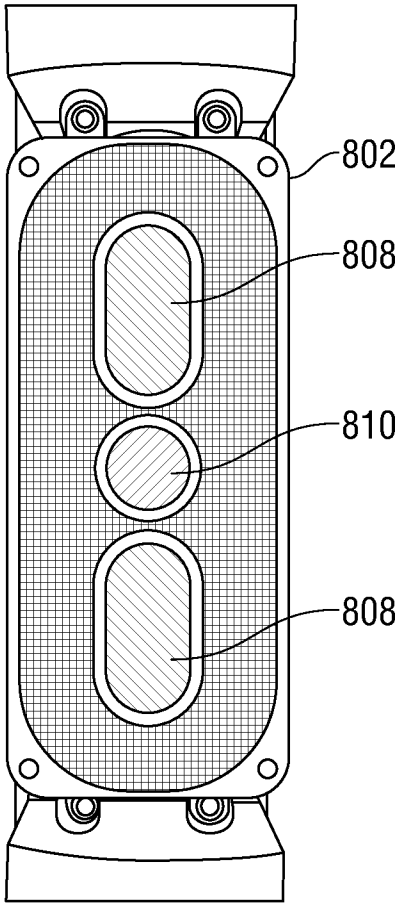
FIG. 8*a* illustrates another embodiment of the invention where a single probe contains a combination of circular and two oval shaped openings.

FIGS. 8*a*-8*c* illustrates examples of three single probe designs 802, 804 and 806 with oval 808 and circular openings 810. A single probe with multiple openings that are independently sealed have been demonstrated in prior art and implemented in practice. Having an integrated probe offers some operational advantages and can simplify the tool design. Having the probe opening in close proximity limits the degree of formation heterogeneity encountered and averages the results over the span of the testing area. The first two probes 802 and 804 (FIGS. 8*a*-8*c*) have separated probe openings for the circular 810 and oval openings 808. In the first probe 802 the oval sections can be coupled together such that they act as one large oval probe. The center circular probe can be tested independently to characterize the anisotropy. Alternatively, a test could be performed by drawing fluid from all three probes to create an additional effective probe geometry. An interference test can be conducted from the center circular probe to observe the response from the oval probes. An interference test can also be performed from one or both of the oval openings and observed by the center opening or second oval opening.

The second probe 804 in FIG. 8*b* illustrates a probe with a large oval opening 808 between two circular openings 810. The testing from the openings would be conducted in a similar manner as described for the first probe 802. Typically, the circular probes would be coupled to act as one probe or they could be operated independently. Interference tests can be run from any of the three openings or a flow test could be run by coupling two or more of the openings together.

The third probe 806 in FIG. 8*c* illustrates a probe with a large oval opening 808 extending over the effective length of the probe with a circular opening 810 positioned within the oval opening. A sealing element 812 hydraulically isolates the center circular opening 810 from the larger oval opening 808. Interference tests can be run between the oval 808 and circular opening 810 with either opening being used as the observation probe. The two openings could be coupled together hydraulically to act as one probe.

Figure 9A:
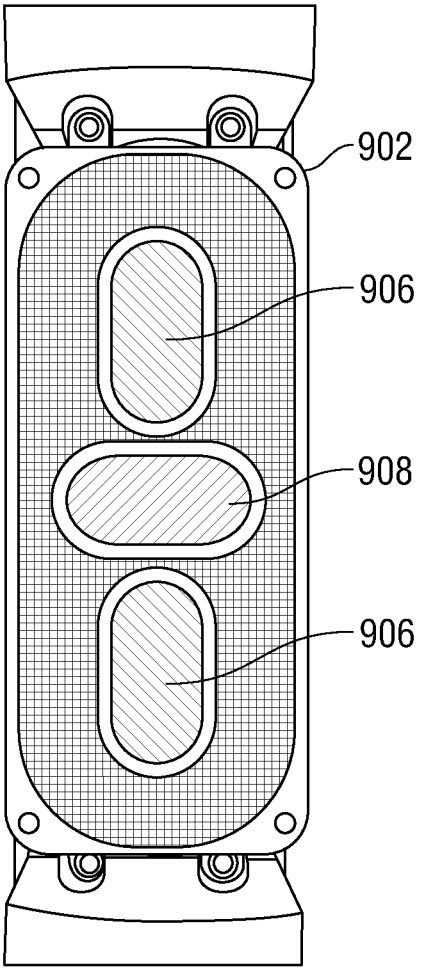
FIG. 9*a* illustrates another embodiment of the invention where a single probe contains oval shaped openings and having orthogonal orientations with one probe horizontal.
Figure 9B:
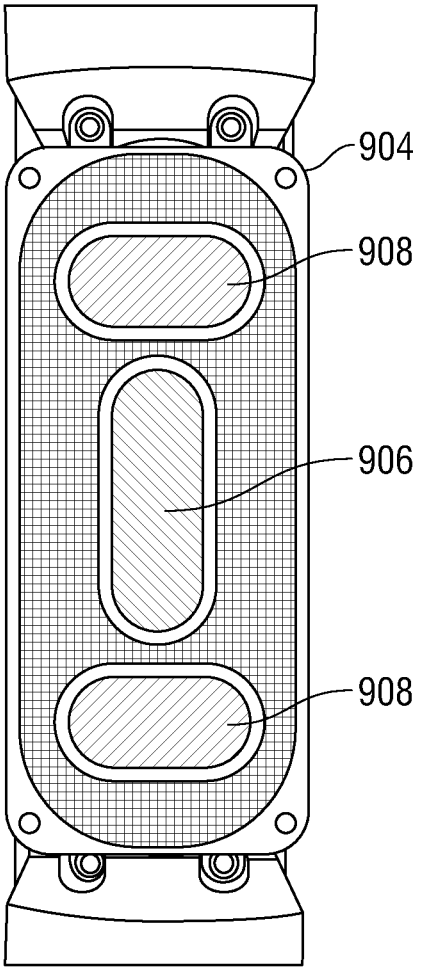
FIG. 9*b* illustrates another embodiment of the invention where a single probe contains oval shaped openings and having orthogonal orientations with two probes horizontal.

FIGS. 9*a* and 9*b* illustrate two probes 902 and 904 with oval openings positioned vertically 906 and horizontally 908. Having elongated probes posited orthogonally would improve the sensitivity of the probe coefficient to anisotropy, as shown in U.S. Pat. No. 5,279,153. In the prior art, the horizontal and vertical openings are overlaying or centered and not separated as shown in FIGS. 9*a*-9*b*. This separation enables a direction of permeability or mobility to be made in the direction of their separation. In addition, the methods shown in this invention do not require an alignment of the probe openings to the anisotropy. The variance with the probe anisotropy can be characterized with an analytical model or numerical simulations and consider the relative dip and probe azimuthal angle with respect to the anisotropy when determining the probe coefficient. The probes in FIGS. 9*a*-9*b* can be operated in a similar manner that is described for the probes in FIGS. 8*a*-8*c*.

Figure 10A:
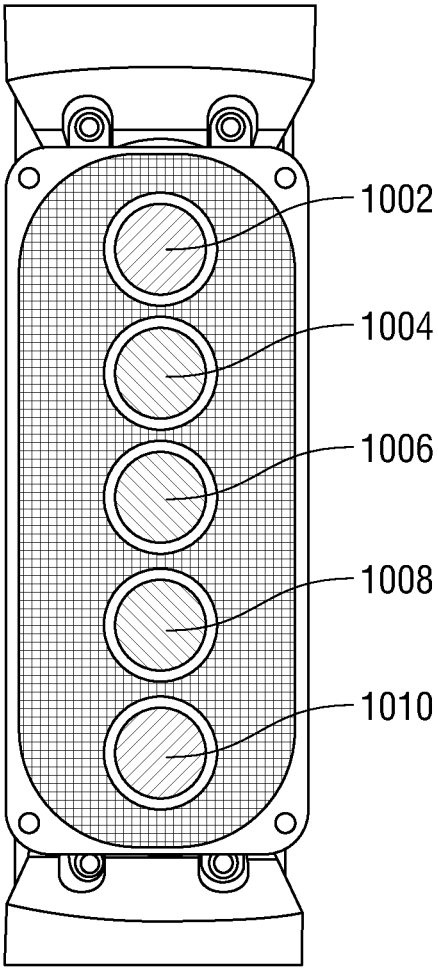
FIG. 10*a*-10*b* illustrate other embodiments of the present invention with a probe consisting of a vertical array of circular openings where the openings can be coupled together to create an effective oval shape used in combination with at least one circular probe.
Figure 10B:
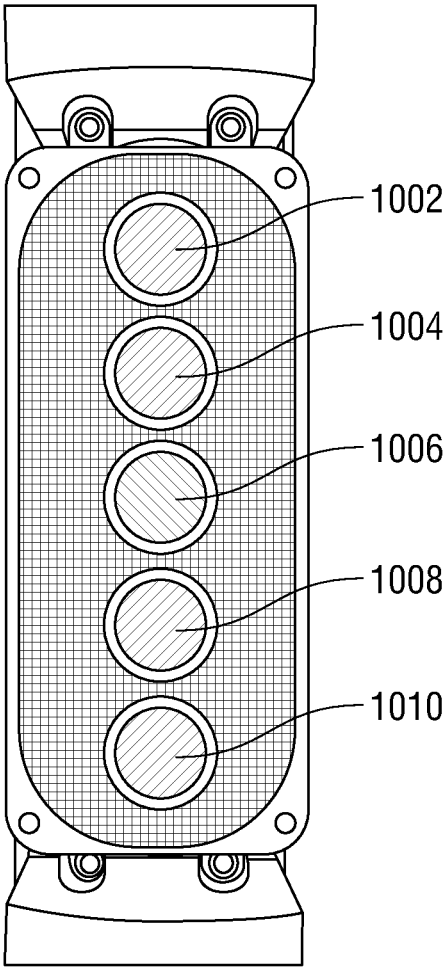

FIGS. 10*a*-10*b* illustrates a probe with an array of 5 circular openings 1002 through 1010. In one illustration, FIG. 10*a* the probe shading shows that 1002 and 1010 are coupled together and 1004, 1006 and 1008 are coupled together, both hydraulically. This creates a geometry similar to the probe 804 shown in FIG. 8*b* where the center coupled probes effectively form an elongated shape. In the second implementation in FIG. 10*b* the opening shading illustrates how the circular openings 1002, 1004, 1008 and 1010 are hydraulically coupled with the center opening 1006 acting independently. This creates an effective geometry similar to probes 802 and 806 shown in FIGS. 8*a* and 8*c*. It is understood that more combinations of probes can be coupled together to create additional effective geometries. Additional embodiments of the probes can be envisioned with probes having two columns or more with circular, oval or other shapes to optimize probe configurations for the parameters and testing conditions encountered.

Figure 11C:
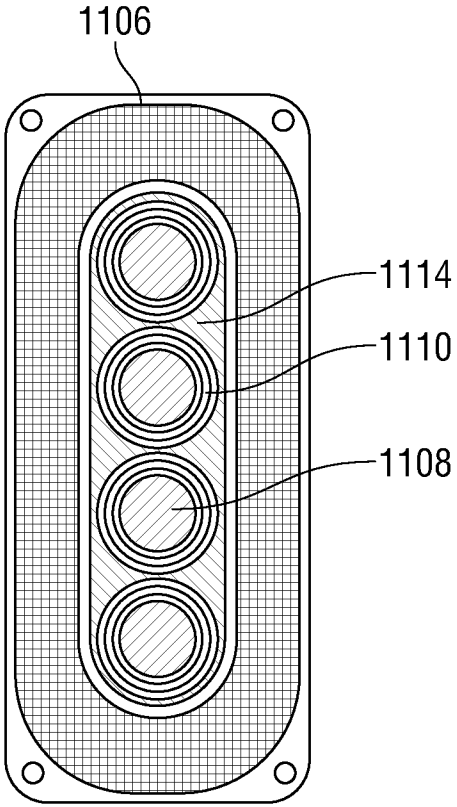
FIG. 11*a*-11*c* illustrate an embodiments in which a single probe can contain smaller openings that are inside of a larger opening.
Figure 11B:
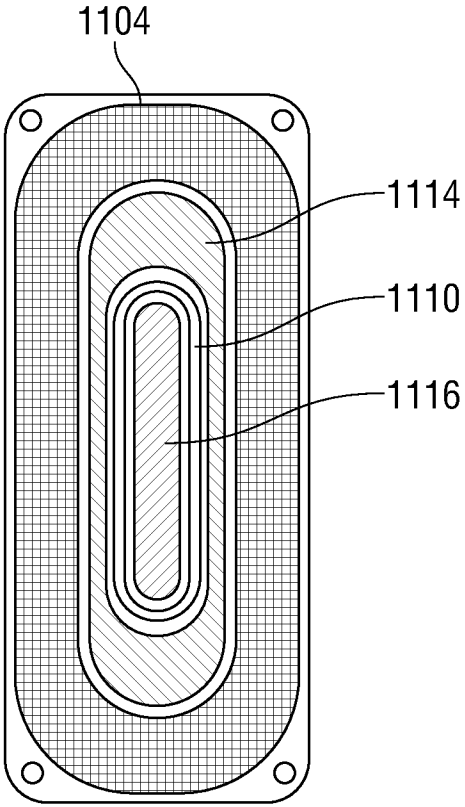
Figure 11A:
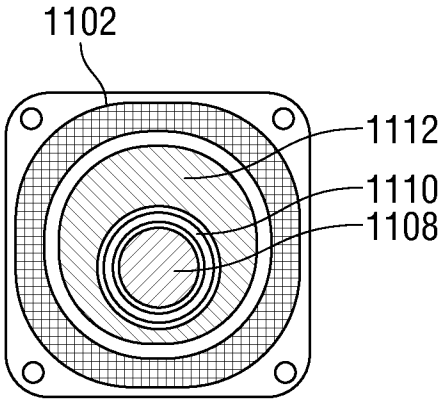

FIGS. 11*a*-11*c* illustrate how one or more probe openings can be arranged and combined. Two circular shapes are combined in 1102 with one circular opening 1108 inside a larger toroidal ring-shaped opening 1112 (FIG. 11*a*). This type of probe is called a circular focused probe in previous art, such as shown in U.S. Pat. No. 6,301,959. The probe illustration 1104 (FIG. 11*b*) illustrates an oval or elongated 1116 shape inside of a larger elongated toroidal probe 1114. This type probe is also used in the industry, as shown in U.S. Pat. No. 9,752,433. The third illustration 1106 (FIG. 11*c*) shows an array of circular probes inside an elongated probe. In each case the inner probe's areas 1108 are sealed from the outer probe 1114 area with a sealing element 1110 that is similar to probe 806, illustrated in FIGS. 8*a*-8*c*. Other probe shapes and combinations can be envisioned such as an elongated probe inside of a circular probe. Each opening and the combination of the openings can be characterized with a shape factor related to one or more formation properties, as with the other examples shown. While probes with different geometries have been used in the art of formation testing, a new testing method and analysis is implemented in this invention enabling an additional property to be determined such as the skin damage. By performing an interference test between the openings, a directional component of permeability or mobility related to anisotropy can be determined and this can be used to determine the additional formation property.

Figure 12A:
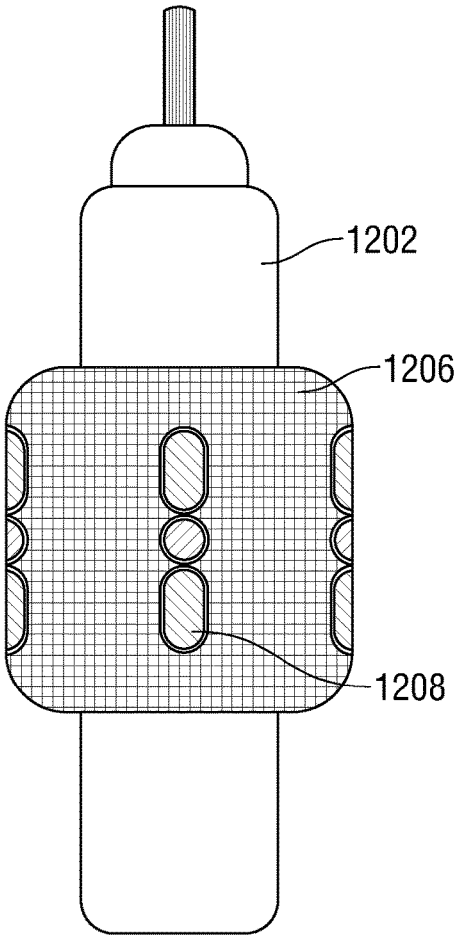
FIGS. 12*a*-*b* illustrate two embodiments of formation testing tools with an expandable element used to place a radial array of probes in sealing communication with the formation.
Figure 12B:
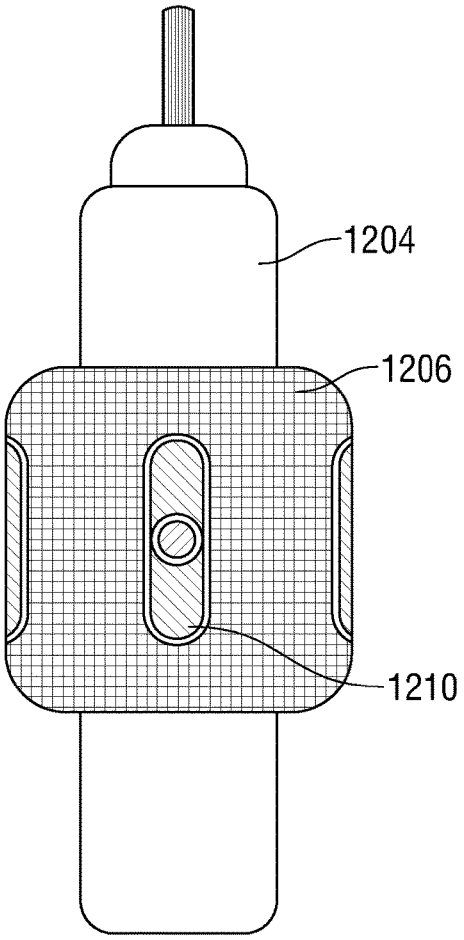

FIG. 12*a*-12*b* illustrate two testing tool embodiments 1202 and 1204 with a more complex radial probe array. Both employ an expanding element 1206 that places the probe openings in sealing communication with the formation, as shown in U.S. Pat. No. 9,422,811. The first tool 1202 has four sets of openings 1208 consisting of oval and circular openings, similar to 802 in FIGS. 8*a*-8*c*, placed in a radial array around the borehole.

The second tool 1204 has four sets of openings 1210 consisting of a circular probe inside of a large oval probe similar to 806 in FIG. 8, that are placed in a radial array around the borehole. It is understood that any of the previous probe opening shapes could be used and even additional shapes not presented. While expandable elements with circular and oval shaped openings have been used in the art of formation testing, a new testing method and analysis is implemented in this invention enabling an additional property to be determined such as the skin damage.

Some primary features of this invention are to have two or more probe shapes available for testing, enabling the determination of at least the formation permeability, anisotropy and skin. With more complex probe arrays and testing data from these probe arrays, additional geometric formation data can be solved for including multiple bedding planes, bed boundaries, bed permeabilities, permeability tensors, and well bore skin damage at various depths. Or, as mentioned previously, a number of testing positions within the wellbore can be used in an analysis for an advanced characterization of a formation depth interval.

While preferred embodiments have been shown, and described, modifications thereof can be made by one skilled in the art without departing from the scope or teaching herein. The embodiments described herein are exemplary only and are not limiting. Many variations and modifications of the system and apparatus are possible and will become apparent to those skilled in the art once the above disclosure is fully appreciated. For example, the relative dimensions of various parts, the materials from which the various parts are made, and other parameters can be varied.

The invention claimed is:

1. A method for estimating horizontal permeability, vertical permeability, or skin damage of an earth formation comprising the steps of:

placing at least one probe with at least two apertures in sealing communication with the formation into a formation testing tool; wherein each individual aperture is in hydraulic communication with a pressure gauge;

establishing hydraulic communication with the formation with at least two of said apertures;

activating a piston in the formation tester tool to withdraw fluid from a first aperture of said at least two apertures;

activating said piston in said formation tester to withdraw fluid from a second aperture of said at least two apertures;

measuring pressure change during a piston deactivation and activation cycle with said first and second apertures simultaneously with two pressure gauges in communication with said at least two apertures;

processing pressure data measurements from said first and second apertures and to determine the anisotropy $K_v/K_h$;

processing pressure data from the pressure data measured from at least one aperture adjacent to a least one flowing aperture to determine formation skin damage S, horizontal permeability $K_h$ and vertical permeability $K_v$.

2. The method of claim 1, wherein the testing is performed at two or more depth locations along the wellbore including pressure gradients to determine at least three formation properties along the interval tested.

3. An apparatus for estimating horizontal permeability, vertical permeability, or skin damage of an earth formation, comprising:

at least one probe that is in sealing communication with the earth formation;

said at least one probe comprises:

two or more probe apertures of different shapes that are configured to be independently sealed in communication with said earth formation;

a withdrawal piston, or pump, for withdrawal of, or injection of fluids into said earth formation from at least two probe apertures;

a first gauge for measuring a pressure disturbance magnitude from said two or more probe apertures;

a processor for estimating at least one earth formation property using said two or more apertures related to the difference in the shapes of said two or more apertures;

a second gauge for measuring a component of at least one earth formation property that is directionally related to a spatial orientation of said two or more apertures by measuring the pressure from at least one aperture of said two or more apertures used to create the disturbance to at least one aperture of said two or more apertures monitoring the pressure disturbance.

4. The apparatus of claim 3, where two or more separated probes have at least one aperture of a different shape where the two apertures are used separately or coupled together hydraulically to create a third effective shape.

5. The apparatus of claim 3, wherein at least one probe comprises two apertures of a different shape where the apertures are used separately or coupled together hydraulically to create a third effective shape.

6. The apparatus of claim 3, where a single probe consisting of at least three apertures of the same shape and two or more of the apertures are coupled together hydraulically to create at least two different effective shapes.

7. The apparatus of claim 3, where an expanding element consisting of at least two apertures of a different shape where the apertures are configured to be used separately or coupled together hydraulically to create a third effective shape.

8. The apparatus of claim 3, where said pressure disturbance is created by a single withdrawal of fluid at a measured rate from one or more of the apertures followed by a stabilization where the magnitude of the pressure is the difference in the pressure at the end of the flow period and the end of the stabilization time period.

9. The apparatus of claim 3, where said pressure disturbance is a series of fluid withdrawals and injections creating a pressure wave and the pressure magnitude or phase is a measurement of the pressure wave such as the peak to peak pressure differential.

10. The apparatus of claim 3, where at least three formation properties are determined, including but not limited to: spherical permeability or mobility; the permeability or mobility in at least one direction; permeability or mobility anisotropy; skin damage of at least one formation bed; distance to one bed boundary; thickness of at least one bed boundary; relative dip angle of borehole to bedding boundaries, azimuthal displacement around the borehole and properties of multiple bedding planes in a formation interval.

11. An apparatus for estimating horizontal permeability, vertical permeability, or skin damage of an earth formation, comprising:

at least two probes with singular apertures of different shapes that are in sealing communication with the earth formation;

at least one probe of said at least two probes comprises;

two or more probe apertures of different shapes that are configured to be independently sealed in communication with said earth formation;

a withdrawal piston, or pump, for withdrawal of, or injection of fluids into said earth formation from at least two probe apertures;

a first gauge for measuring a pressure disturbance magnitude from said two or more probe apertures;

a processor for estimating at least one earth formation property using said two or more apertures related to the difference in the shapes of said two or more apertures;

a second gauge for measuring a component of at least one earth formation property that is directionally related to a spatial orientation of said two or more apertures by measuring the pressure from at least one aperture of said two or more apertures used to create the disturbance to at least one aperture of said two or more apertures monitoring the pressure disturbance.

12. The apparatus of claim 11, where two or more separated probes have at least one aperture of a different shape where the two apertures are used separately or coupled together hydraulically to create a third effective shape.

13. The apparatus of claim 11, wherein at least one probe comprises two apertures of a different shape where the apertures are used separately or coupled together hydraulically to create a third effective shape.

14. The apparatus of claim 11, where a single probe consisting of at least one smaller aperture positioned inside of a larger aperture and any of the remaining apertures are used separately or coupled together hydraulically to create a different effective shape.

15. The apparatus of claim 11, where a single probe consisting of at least three apertures of the same shape and two or more of the apertures are coupled together hydraulically to create at least two different effective shapes.

16. The apparatus of claim 11, where an expanding element consisting of at least two apertures of a different shape where the apertures are configured to be used separately or coupled together hydraulically to create a third effective shape.

17. The apparatus of claim 11, where said pressure disturbance is created by a single withdrawal of fluid at a measured rate from one or more of the apertures followed by a stabilization where the magnitude of the pressure is the difference in the pressure at the end of the flow period and the end of the stabilization time period.

18. The apparatus of claim 11, where said pressure disturbance is a series of fluid withdrawals and injections creating a pressure wave and the pressure magnitude is a measurement of the pressure wave such as the peak to peak pressure differential.

19. The apparatus of claim 11, where the pressure disturbance is a series of fluid withdrawals and injections creating a pressure wave and a shift in phase is measured by comparing the wave from the aperture creating the disturbance to at least one monitoring aperture wave.

20. The apparatus of claim 11, where at least three formation properties are determined, including but not limited to: spherical permeability or mobility; the permeability or mobility in at least one direction; permeability or mobility anisotropy; skin damage of at least one formation bed; distance to one bed boundary; thickness of at least one bed boundary; relative dip angle of borehole to bedding boundaries, azimuthal displacement around the borehole and properties of multiple bedding planes in a formation interval.

* * * * *